US011161030B2

(12) United States Patent
Purcell

(10) Patent No.: US 11,161,030 B2
(45) Date of Patent: Nov. 2, 2021

(54) ADJUSTABLE SNOWBOARD SLED

(71) Applicant: Lee Purcell, Michigan City, IN (US)

(72) Inventor: Lee Purcell, Michigan City, IN (US)

( * ) Notice: Subject to any disclaimer, the term of this patent is extended or adjusted under 35 U.S.C. 154(b) by 0 days.

(21) Appl. No.: 16/847,307

(22) Filed: Apr. 13, 2020

(65) Prior Publication Data

US 2020/0324186 A1 Oct. 15, 2020

Related U.S. Application Data

(60) Provisional application No. 62/833,572, filed on Apr. 12, 2019.

(51) Int. Cl.
*A63C 5/03* (2006.01)

(52) U.S. Cl.
CPC ..... *A63C 5/033* (2013.01); *A63C 2203/46* (2013.01)

(58) Field of Classification Search
CPC ..... A63C 2203/46; A63C 5/033; A63C 10/26; A63C 17/0046; A63C 17/012; A63C 5/03
USPC ..... 280/15
See application file for complete search history.

(56) References Cited

U.S. PATENT DOCUMENTS 3,744,811 A * 7/1973 Johnston ..... B62B 13/16 280/28.14
3,802,714 A * 4/1974 Freegard ..... A63C 5/033 280/607
4,725,069 A * 2/1988 Stampacchia ..... A63C 5/031 280/607
6,857,641 B2 * 2/2005 Bobrowicz ..... A63C 5/03 280/14.21
6,910,695 B2 * 6/2005 Ellington ..... A63C 5/033 280/14.22
8,632,079 B2 * 1/2014 Ryan ..... A63C 5/03 280/14.21
9,981,178 B1 * 5/2018 Huynh ..... A63C 5/03
10,695,653 B2 * 6/2020 Flowers ..... A63C 5/06
2002/0008360 A1 * 1/2002 Ellington ..... A63C 5/033 280/14.21
2002/0043774 A1 * 4/2002 Chou ..... A63C 17/01 280/7.12
2002/0070515 A1 * 6/2002 Barbieri ..... A63C 5/03 280/14.21
2002/0158430 A1 * 10/2002 Farcot ..... B23H 9/00 280/14.21
2002/0190501 A1 * 12/2002 Barbieri ..... A63C 5/03 280/604
2003/0085537 A1 * 5/2003 Breuer ..... A63C 5/03 280/14.21
2003/0160404 A1 * 8/2003 Bobrowicz ..... B62B 13/043 280/14.21

(Continued)

FOREIGN PATENT DOCUMENTS

WO WO-2015143482 A1 * 10/2015 ..... B62B 17/062

*Primary Examiner* — John D Walters
*Assistant Examiner* — Hilary L Johns
(74) *Attorney, Agent, or Firm* — Faegre Drinker Biddle & Reath LLP

(57) ABSTRACT

Embodiments of the present disclosure provide a sled having a sled attachment and a runner. The sled attachment may include a control deck and a connector assembly coupled to and positioned below the control deck. The runner may be coupled to the connector assembly and spaced apart from the deck. The runner may extend along a longitudinal axis of the control deck. The runner may comprise a snowboard.

18 Claims, 23 Drawing Sheets

(56) References Cited

U.S. PATENT DOCUMENTS

| | | | | |
|---|---|---|---|---|
| 2003/0193168 | A1* | 10/2003 | Chou | A63C 5/02<br>280/607 |
| 2006/0091645 | A1* | 5/2006 | Cobb | A63C 5/0405<br>280/609 |
| 2006/0226613 | A1* | 10/2006 | Wilson | A63C 5/075<br>280/14.22 |
| 2011/0248457 | A1* | 10/2011 | Kosmehl | A63C 5/0422<br>280/14.22 |

* cited by examiner

ADJUSTABLE SNOWBOARD SLED

CROSS-REFERENCE TO RELATED APPLICATION

The present application claims priority to U.S. Provisional Patent Application Ser. No. 62/833,572, filed Apr. 12, 2019, the disclosure of which is expressly incorporated herein by reference.

FIELD OF THE DISCLOSURE

The present disclosure relates to a sled and, in particular, a sled having a control deck offset from a longitudinal runner with a connector assembly.

BACKGROUND OF THE DISCLOSURE

Sleds are often used in the transportation industry for transporting people and goods across low friction surfaces, such as, for example, snow. Sleds are also used by outdoor enthusiasts for, among other things, entertainment purposes. Current sleds on the market today for recreational use are often simple, cheap, and usually a single piece of plastic. Alternatives to current recreational sleds are innertubes that can be fragile, bulky, and hard to transport or inflate.

Current recreational sleds on the market also typically lack turnability and tunability. They usually only turn if the terrain allows and are sold and used "as is". To obtain a sled that features both turnability and tunability, the only options on the market today are bobsleighs, skeletons, and luges. However, while these options are generally accepted sports, the equipment is not readily available to the average snow enthusiast. They are often expensive and require highly specialized tracks and training.

SUMMARY OF THE DISCLOSURE

A sled is disclosed having a control deck, a connector assembly, and a runner. The connector assembly is coupled to the control deck and the runner such that the runner is offset from the control deck. The runner is aligned along a longitudinal axis of the deck and may comprise a snowboard. The deck is adapted to support an operator during use of the sled. In one particular embodiment, the connector assembly is selectively adjustable to change a distance between the deck and the runner.

According to an exemplary embodiment of the present disclosure, a sled is provided comprising a control deck, a connector assembly coupled to and positioned below the control deck, and a runner coupled to the connector assembly and spaced apart from the control deck. The runner extends along a longitudinal axis of the control deck.

According to another exemplary embodiment of the pressure disclosure, a sled attachment is provided comprising a control deck and a connector assembly coupled to the control deck. The connector assembly extends downward from the control deck and is positioned along a longitudinal axis of the control deck.

According to a further exemplary embodiment of the present disclosure, a method is provided for assembling a sled. The method includes the steps of providing a control deck comprising a platform having an upper surface and a lower surface, coupling a connector assembly to the control deck, and coupling the connector assembly to a runner such that the connector assembly is intermediate the control deck and the runner.

Additional features and advantages of the present invention will become apparent to those skilled in the art upon consideration of the following detailed description of the illustrative embodiments exemplifying the best mode of carrying out the invention as presently perceived.

BRIEF DESCRIPTION OF THE DRAWINGS

The foregoing aspects and many of the intended advantages of this invention will become more readily appreciated as the same becomes better understood by reference to the following detailed description of exemplary embodiments when taken in conjunction with the accompanying drawings, wherein:

FIG. 20 is a front, top perspective view of another exemplary sled including a control deck, an adjustable connector assembly, and a runner in a lowered configuration;

Figure 1A:
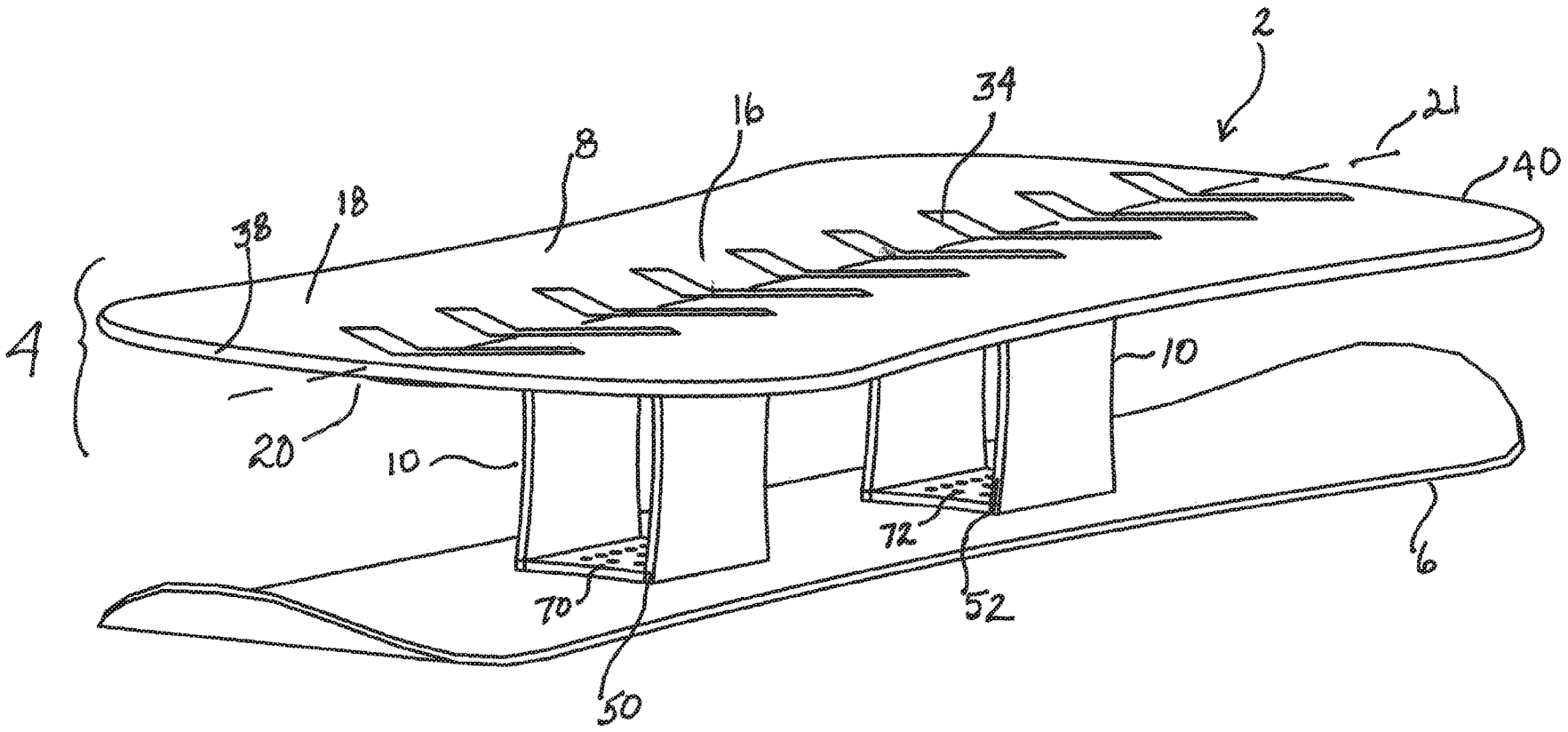
FIG. 1A is a front, top perspective view of an exemplary sled including a control deck, a connector assembly, and a runner.

Corresponding reference characters indicate corresponding parts throughout the several views. Although the drawings represent exemplary embodiments of various features and components according to the present disclosure, the drawings are not necessarily to scale and certain features may be exaggerated in order to better illustrate and explain the present disclosure. Moreover, the exemplifications set out herein illustrate exemplary embodiments of the invention, and such exemplifications are not to be construed as limiting the scope of the invention in any manner.

DETAILED DESCRIPTION OF THE DRAWINGS

For the purposes of promoting an understanding of the principles of the present disclosure, reference is now made to the exemplary embodiments illustrated in the drawings, which are described below. The exemplary embodiments disclosed below are not intended to be exhaustive or limit the present disclosure to the precise form disclosed in the following detailed description. Rather, the exemplary embodiments are chosen and described so that others skilled in the art may utilize their teachings. Therefore, no limitation of the scope of the present disclosure is thereby intended.

Figure 1B:
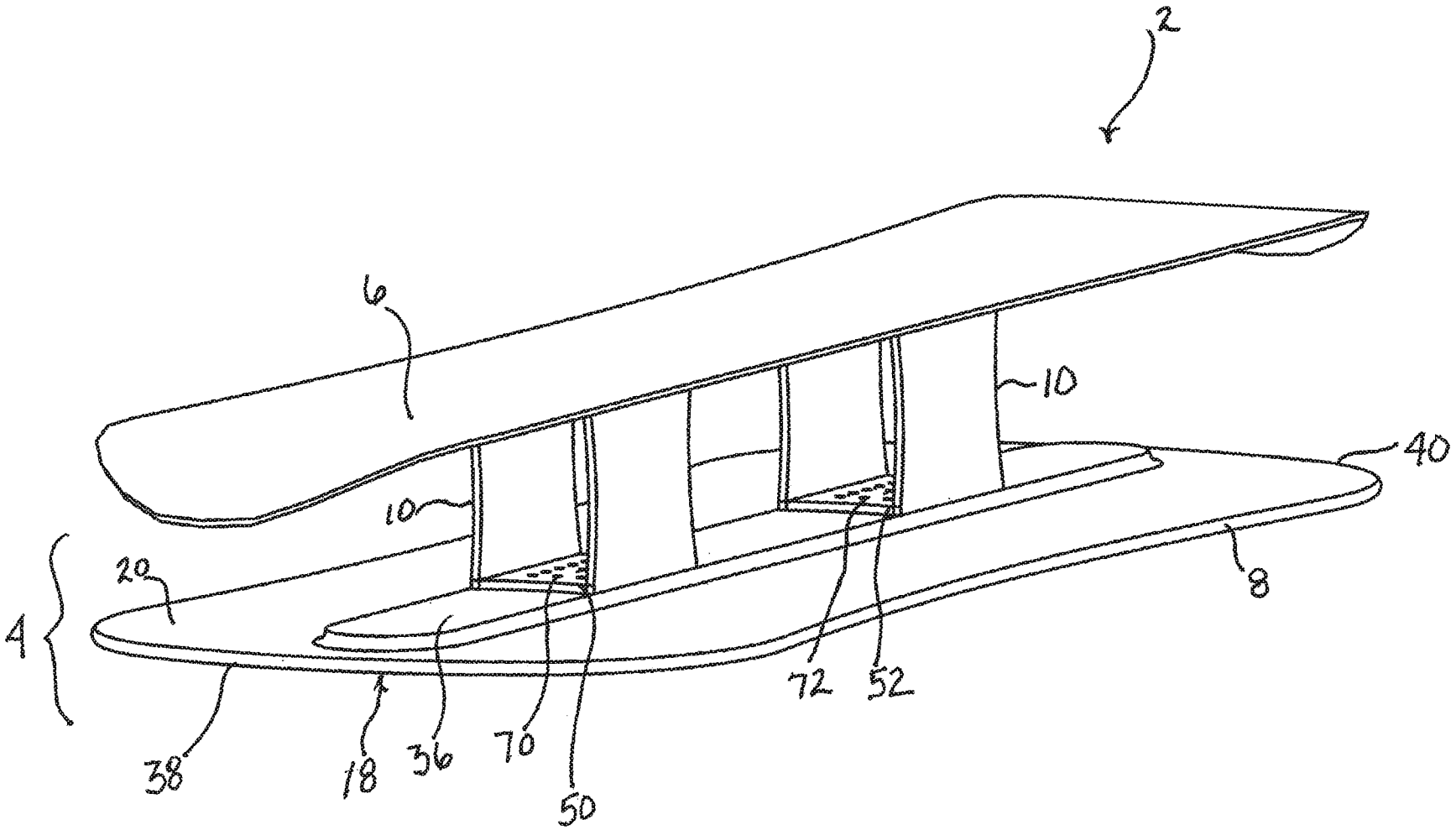
FIG. 1B is a front, bottom perspective view of the sled of FIG. 1A.

Referring initially to FIGS. 1A and 1B, a sled 2 according to an illustrative embodiment of the invention is shown. Sled 2 includes a sled attachment 4 coupled to a runner 6. Sled attachment 4 includes a control deck 8 and a connector assembly 10. Control deck 8 is configured to support an operator 12 (FIG. 36) during operation of sled 2, and connector assembly 10 supports control deck 8 above runner 6 that is configured to support operator 12 for movement along a low friction surface, such as, for example, snow, ice, sand, or wet grass. As shown in at least FIGS. 1A and 1B, runner 6 comprises a snowboard 14.

Referring now to FIGS. 2-5, control deck 8 is shown in more detail. Control deck 8 comprises a platform 16 having an upper surface 18 and a lower surface 20 opposite upper surface 18. Platform 16 extends longitudinally along a longitudinal axis 21 from a first end 22 to a second end 24. As shown, platform 16 includes a contoured perimeter 26 with rounded edges 28 at each of ends 22, 24. In addition, platform 16 includes opposing side cuts 30 to outline a waist 32 of platform 16. Platform 16 is symmetrical about longitudinal axis 21 and has a width $w_1$ that is smaller than a width $w_2$ of either of ends 22, 24 (i.e., $w_2>w_1$). It is contemplated that in alternate embodiments, platform 16 may have generally constant width along longitudinal axis 21 or may have a width $w_1$ that is larger than width $w_2$ (i.e., $w_1>w_2$).

Upper surface 18 of platform 16 is illustratively a non-slip surface and may include a visual indicator such as a plurality of arrows 34 to indicate to an operator a front end, illustratively first end 22, and a rear end, illustratively second end 24, of control deck 8 or an intended direction of travel or operation of sled 2. It is contemplated that in alternate embodiments, an alternative visual indicator could be used, such as, for example, words or other geometric shapes. In another alternate embodiment, no visual indicator may be used. In an alternate embodiment, upper surface 18 may include a textured process, such as, e.g., flocking, for increasing the friction between upper surface 18 and operator 12. Platform 16 can be made of a manufactured material, such as plywood, for example. In one embodiment, platform 16 comprises a marine-grade plywood. It is contemplated, however, that platform 16 may comprise an alternative material, such as, for example, a lightweight, strong material formed to maximize direct control while minimizing weight and bulk.

Figure 3:
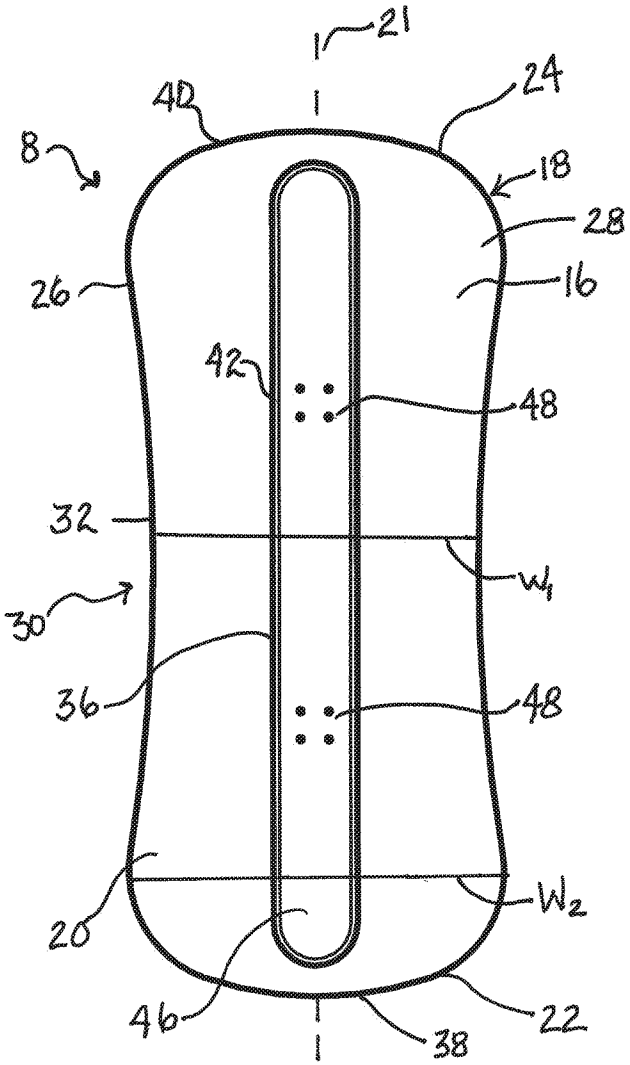
FIG. 3 is a bottom view of the control deck of FIG. 2.
Figure 2:
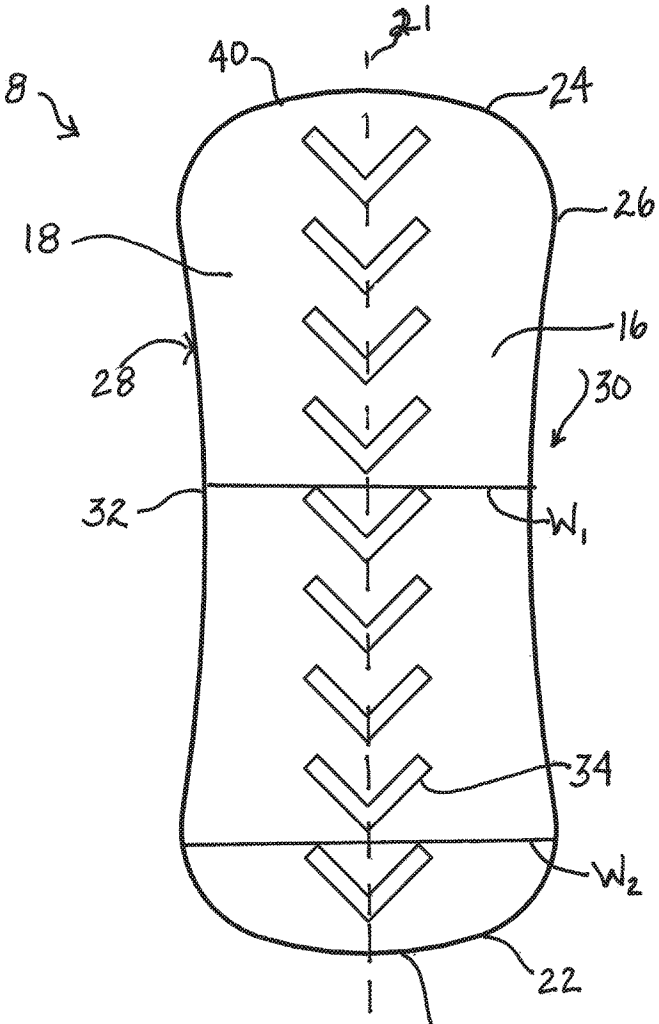
FIG. 2 is a top view of the control deck shown in the sled of FIG. 1A.
Figure 5:
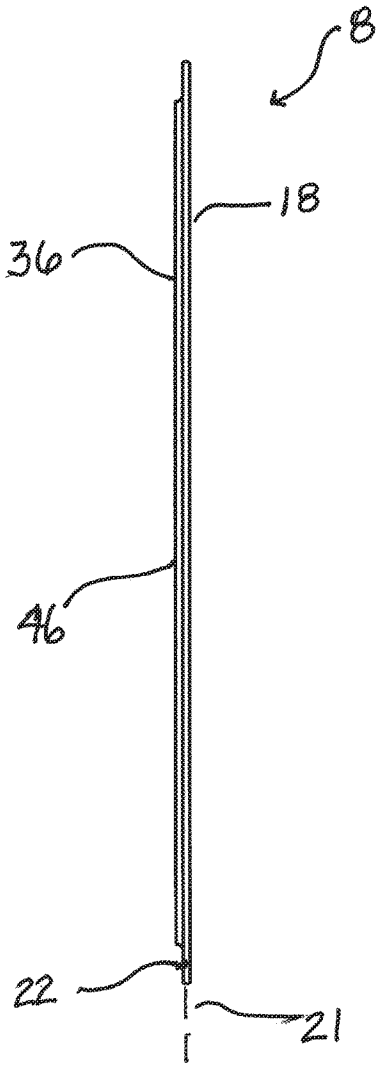
FIG. 5 is a side view of the control deck of FIG. 2.
Figure 4:
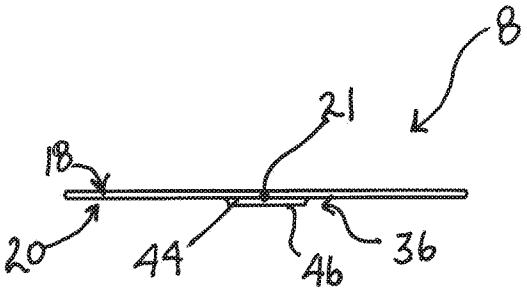
FIG. 4 is a front view of the control deck of FIG. 2.
Figure 7:
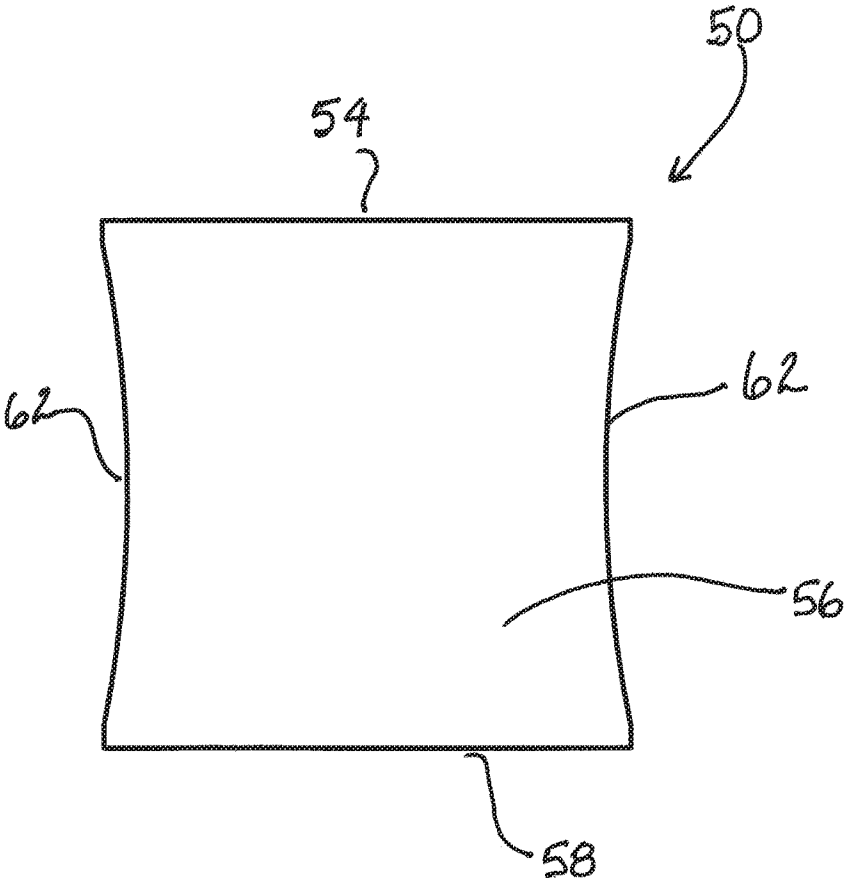
FIG. 7 is a side view of the connector of FIG. 6.
Figure 6:
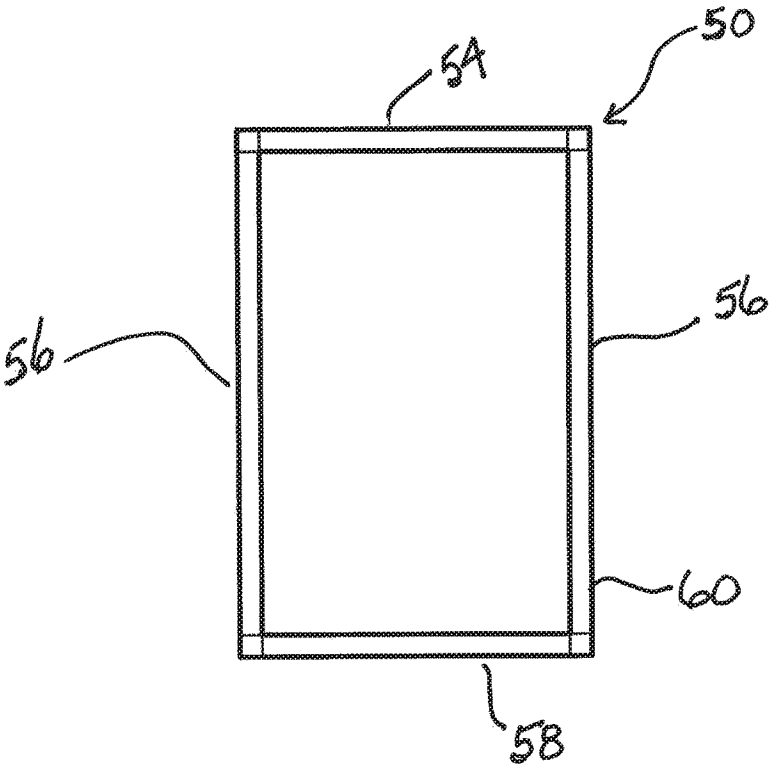
FIG. 6 is a front view of a connector assembly or riser of the connector shown in the sled of FIG. 1A.
Figure 9:
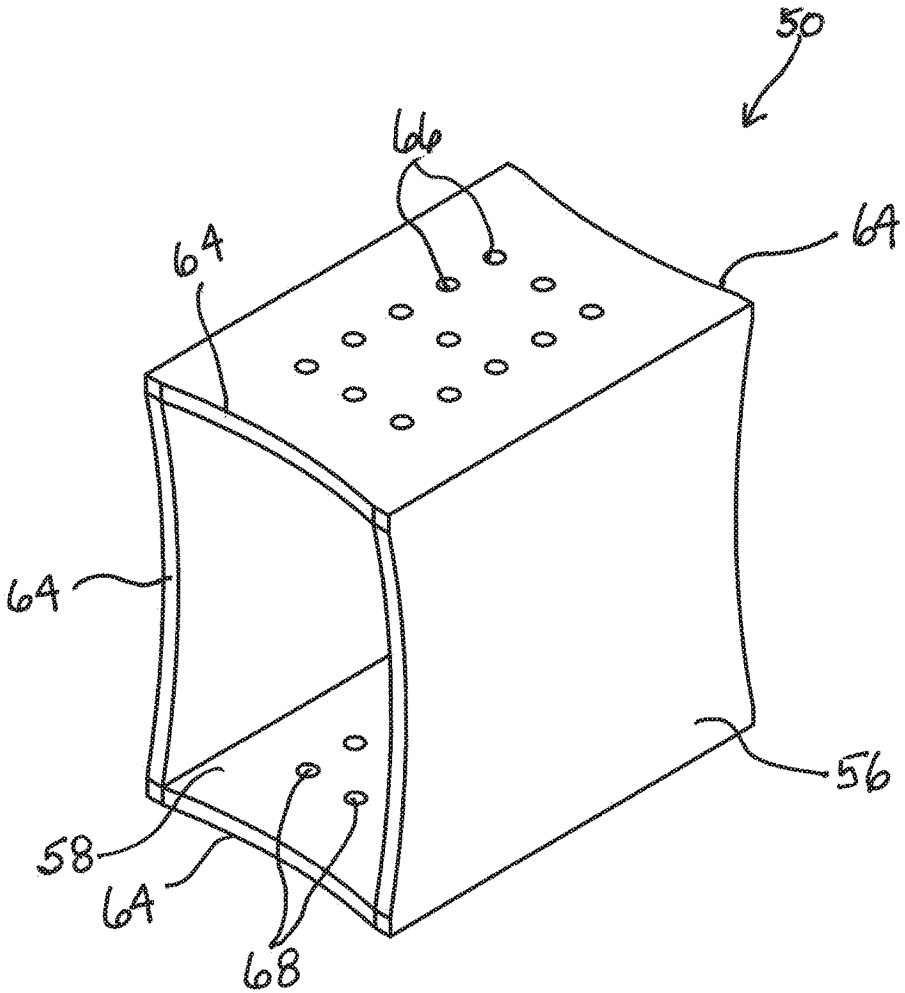
FIG. 9 is a front, top perspective view of the connector of FIG. 6.
Figure 8:
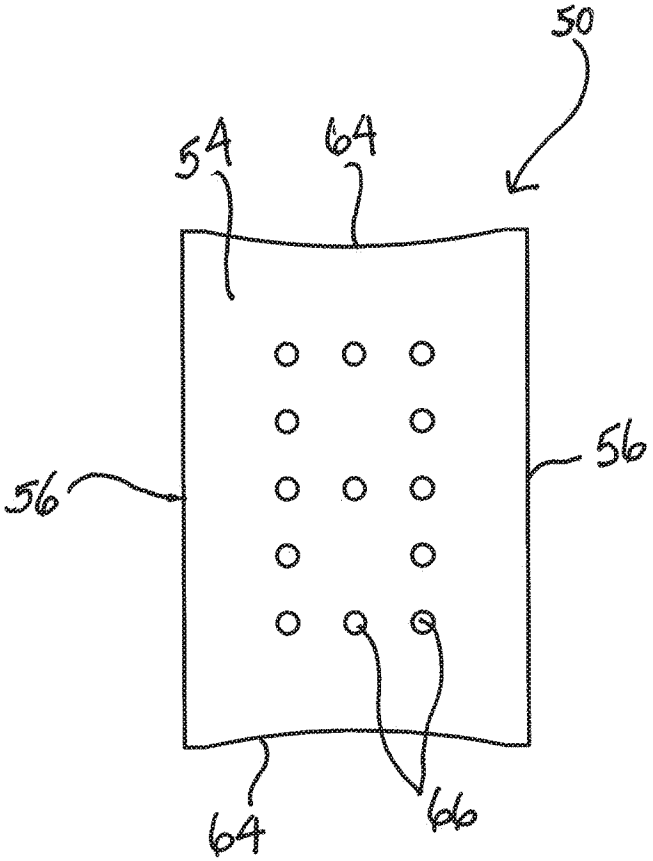
FIG. 8 is a top view of the connector of FIG. 6.
Figure 10:
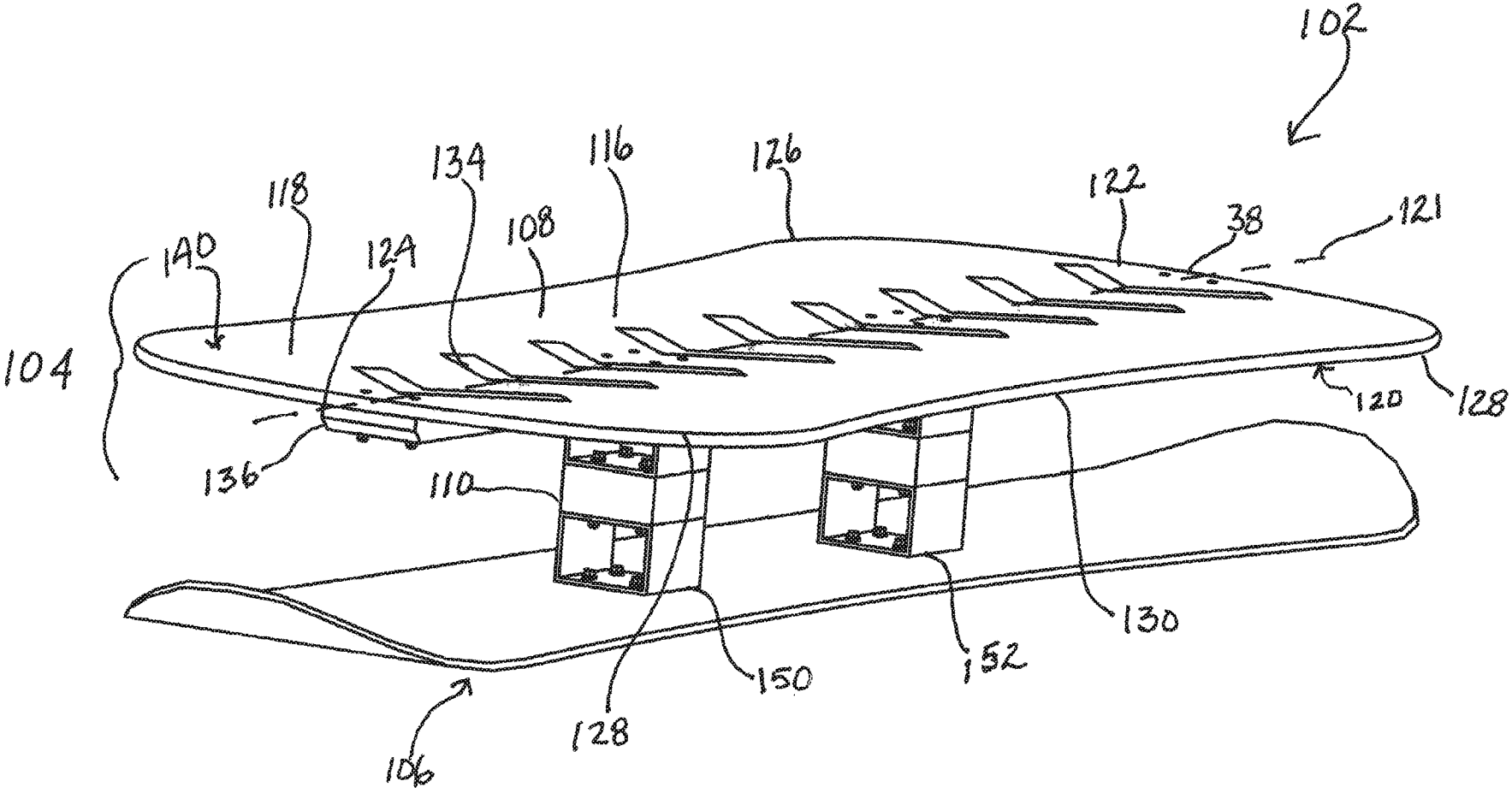
FIG. 10 is a front, top perspective view of another exemplary sled including a control deck, an adjustable connector assembly, and a runner.
Figure 11:
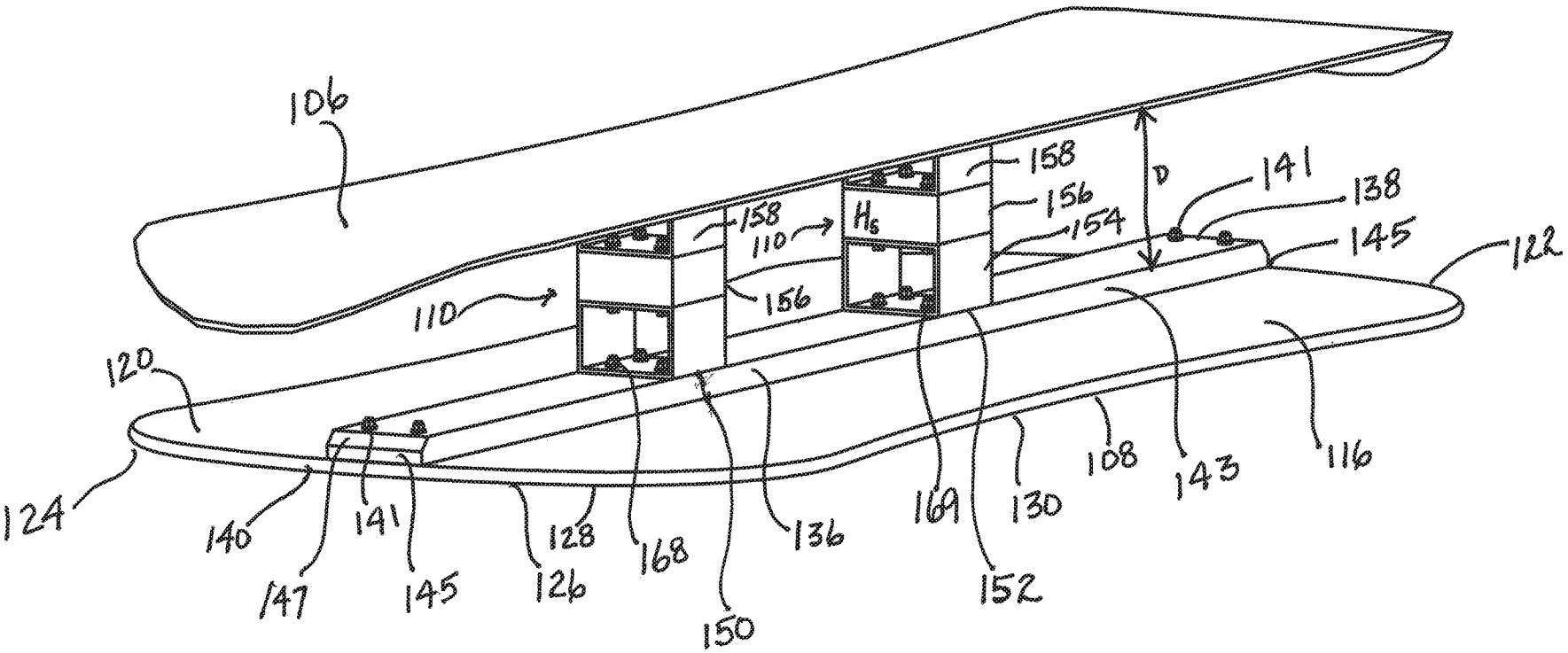
FIG. 11 is a front, bottom perspective view of the sled of FIG. 10.
Figure 13:
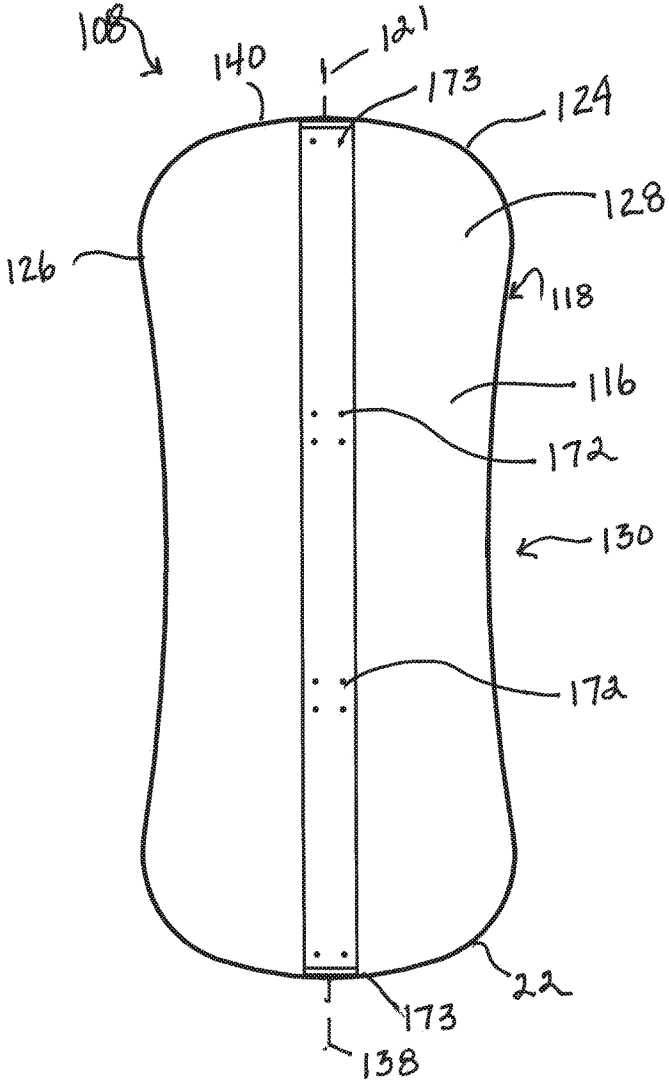
FIG. 13 is a bottom view of the control deck of FIG. 12.

As shown in FIGS. 3-5, illustrative control deck 8 further includes a stringer 36 coupled to lower surface 20 of platform 16. Stringer 36 is configured to receive connectors 50, 52 as discussed in greater detail herein. Stringer 36 has a contoured profile 42 with a chamfered edge 44. Stringer 36 longitudinally extends along longitudinal axis 21 from a first end 38 to a second end 40 opposite first end 38. As shown in FIG. 3, the first end 38 and the second end 40 of stringer 36 are not in substantial alignment with the first end 22 or the second end 24 of platform 16. However, in an alternate embodiment, stringer 36 may extend to substantially span the length of platform 16 such that the first end 38 and the second end 40 are in substantial alignment with first end 22 and second end 24, respectively. Stringer 36 may be adhered to lower surface 20 using a structural adhesive and/or coupled to platform 16 using at least one mechanical fastener. Referring specifically to FIG. 3, a lower surface 46 of stringer 36 includes mounting pattern 48 configured to allow connectors 50, 52 (FIG. 1B) to be coupled along stringer 36 as discussed herein. Mounting pattern 48 includes a plurality of apertures configured to receive fasteners, such as bolts. The plurality of apertures of mounting pattern 48 is configured to match, and to mount to apertures on connectors 50, 52.

As shown in FIGS. 1A and 1B, connector assembly 10 illustratively comprises a front or fore connector 50 and a rear or aft connector 52. Referring now to FIGS. 6-9, connector 50 is shown in greater detail. Connector 52 is similar in structure and function as connector 50 as described herein. Connector 50 includes an upper portion 54, a lower portion 58 spaced apart from upper portion 54, and sidewalls 56 extending from upper portion 54 to lower portion 58. Upper portion 54, lower portion 58, and sidewalls 56 are coupled together to form a frame 60 of connector 50. Sidewalls 56 include vertically extending concave edges 62, and upper portion 54 and lower portion 58 include horizontally extending concave edges 64, which are positioned adjacent concave edges 62 of sidewalls 56. Upper portion 54 also includes a plurality of apertures 66 configured to receive a respective fastener (not shown) to couple connector 50 to stringer 36 of control deck 8. More specifically, a mechanical fastener, such as a bolt, is inserted through a respective one of apertures 66 and inserted into a respective one of mounting patterns 48 to securely couple connectors 50, 52 to stringer. In addition, apertures 66 may be arranged relative to one another in a standard bolt hole pattern. It is also contemplated that upper portion 54 may include a single aperture for coupling to control deck 8. However, an advantage, among others, of apertures 66 is that connectors 50, 52 may be pinned relative to control deck 8 such that undesired relative rotation between connectors 50, 52 and control deck 8 will be minimized or eliminated. In one embodiment, connectors 50, 52 comprise an aluminum extrusion.

Lower portion 58 also includes a plurality of apertures 68 configured to receive a respective fastener (not shown) for coupling connector 50 to runner 6. In the embodiment shown in FIG. 1B, runner 6 comprises a snowboard 14. Therefore, apertures 68 are arranged in a pattern corresponding to the binding mounting pattern of a snowboard such that connectors 50, 52 may be coupled to various snowboards having a variety of binding mounting patterns. Accordingly, snowboard 14 includes a plurality of apertures or holes (not shown) corresponding to a standard binding mounting pattern. A mechanical fastener, such as a bolt, may be passed through a respective one of apertures 68 and inserted into a respective one of the apertures of snowboard 14 for coupling connectors 50, 52 to snowboard 14.

Referring back to FIG. 1B, fore connector 50 coupled to a fore binding mounting pattern 70 while aft connector 52 is coupled to an aft binding mounting pattern 72. When connector assembly 10 is coupled to stringer 36, aft connector 52 is spaced apart from fore connector 50 along longitudinal axis 21 of control deck 8. More specifically, fore connector 50 is positioned intermediate first end 22 and aft connector 52, and aft connector 52 is positioned intermediate fore connector 50 and second end 24. The spacing between connectors 50, 52 is at least partially dependent upon the spacing between the fore and aft binding mounting patterns 70, 72 of snowboard 14. That is, the predetermined locations of fore and aft binding mounting patterns 70, 72 determine the spacing between connectors 50, 52. When assembling connector assembly 10, an operator may adjust the position of connectors 50, 52 along stringer 36 before or after coupling connectors 50, 52 to runner 6 as discussed herein.

Turning now to FIGS. 10-19, an alternative sled 102 is shown, which comprises many similar components to sled 2. In particular, sled 102 comprises a sled attachment 104 coupled to a runner 106. Sled attachment 104 includes a control deck 108 coupled to a connector assembly 110. Control deck 108 is configured to support an operator 12 (FIG. 36) during operation of sled 102, and connector assembly 110 supports control deck 108 above runner 106. Illustratively, runner 106 is configured to support operator 12 for movement along a low friction surface, such as, for example, snow, ice, sand, or wet grass. In the embodiment shown, runner 106 comprises a snowboard 114.

Control deck 108 comprises a platform 116 having an upper surface 118 and a lower surface 120 opposite upper surface 118. Platform 116 extends longitudinally along a longitudinal axis 121 from a first end 122 to a second end 124. Platform 116 includes a contoured perimeter 126 with rounded edges 128 at each of ends 122, 124. In addition, platform 116 includes side cuts 130 to outline a waist of platform 116 similar to waist 32 of platform 16 as previously described. It is contemplated, however, that platform 116 may include a generally constant width along its length or, alternatively, a wider middle width than at either of ends 122, 124. Upper surface 118 is a non-slip surface and includes a visual indicator such as a plurality of arrows 134 to indicate to an operator a front end, illustratively first end 122, and a rear end, illustratively second end 124, of control deck 108 or an intended direction of travel or operation of sled 102.

Figure 12:
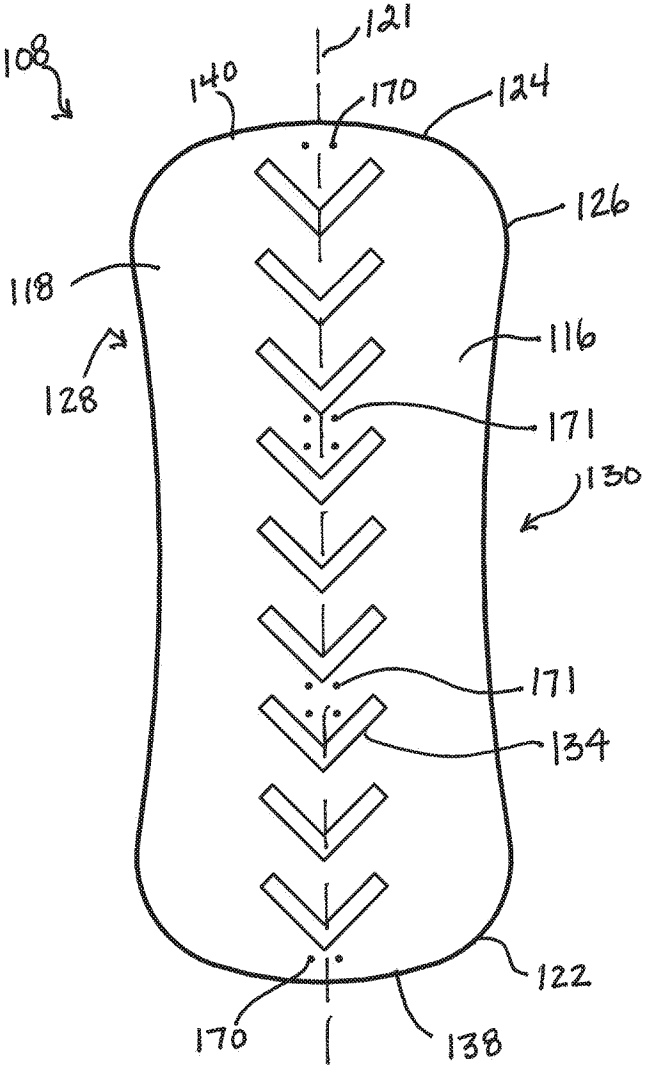
FIG. 12 is a top view of the control deck shown in the sled of FIG. 10.
Figure 15:
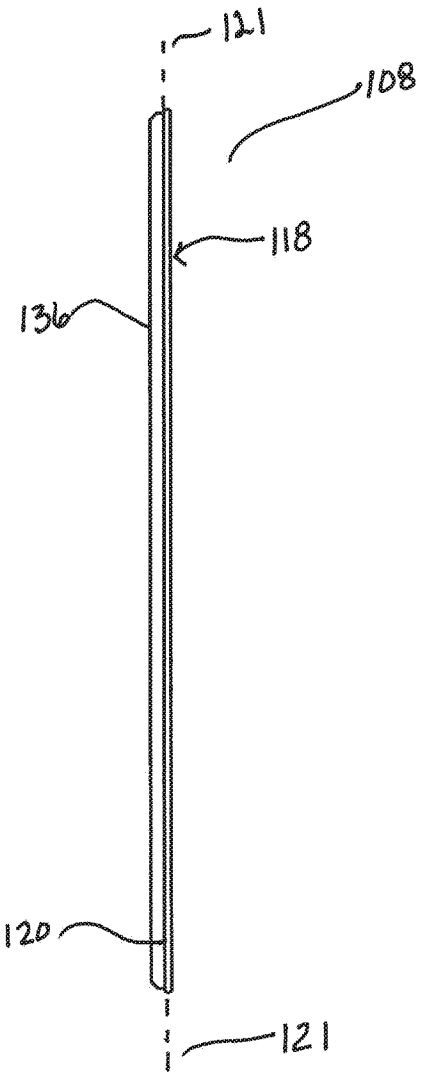
FIG. 15 is a side view of the control deck of FIG. 12.
Figure 14:
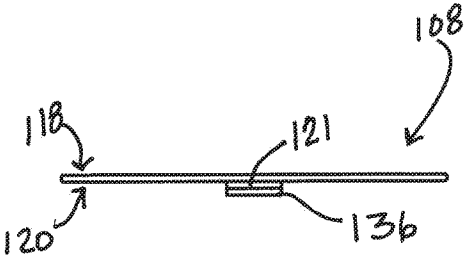
FIG. 14 is a front view of the control deck of FIG. 12.
Figure 17:
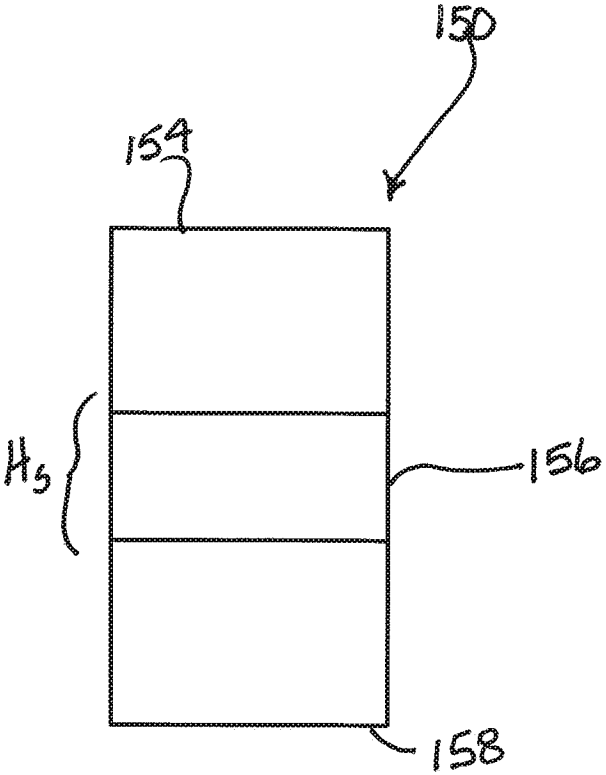
FIG. 17 is a side view of the connector of FIG. 16.
Figure 16:
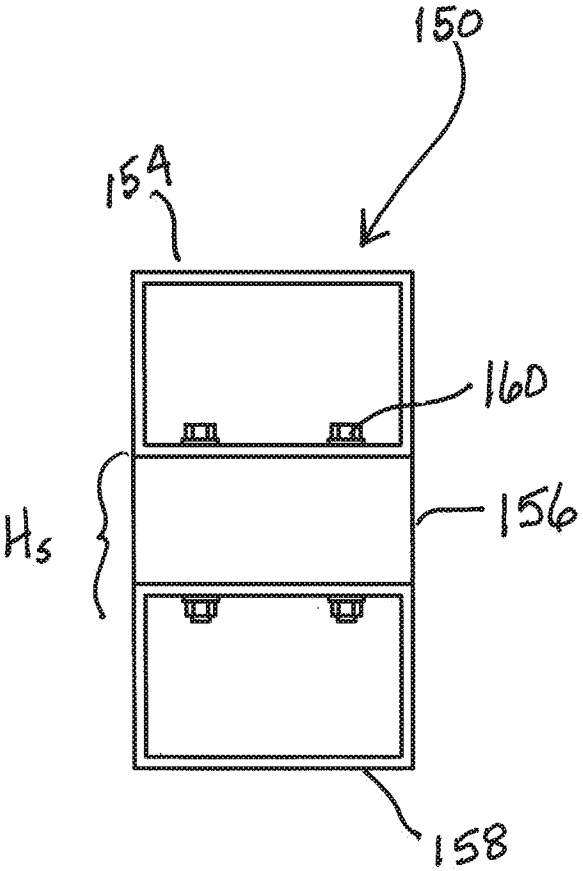
FIG. 16 is a front view of a connector assembly or riser of the connector shown in the sled of FIG. 10.
Figure 19:
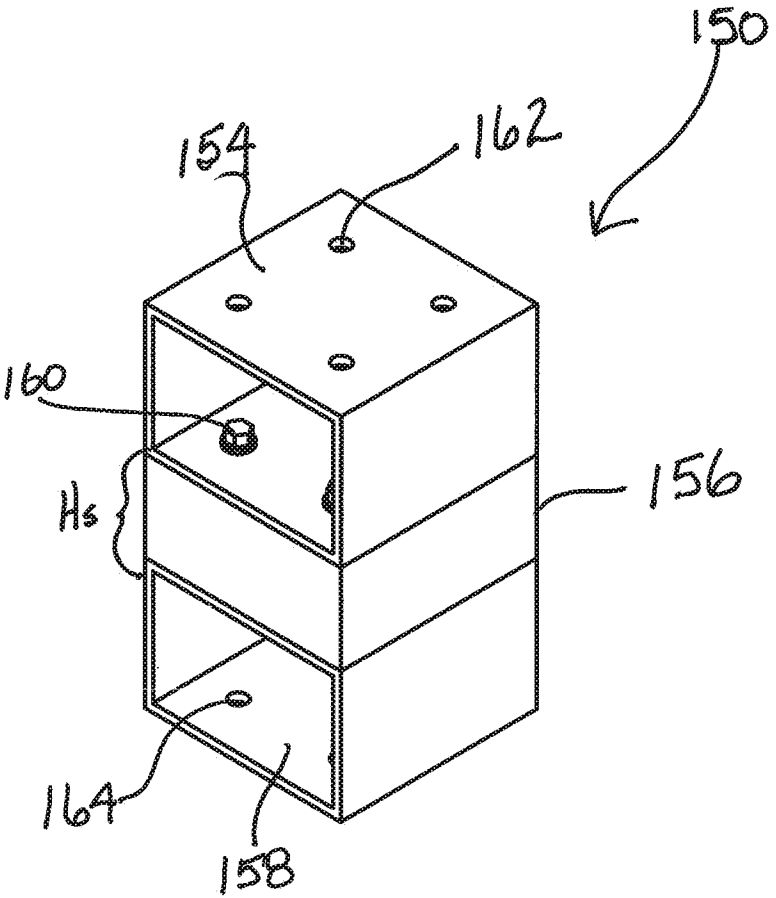
FIG. 19 is a front, top perspective view of the connector of FIG. 16.
Figure 18:
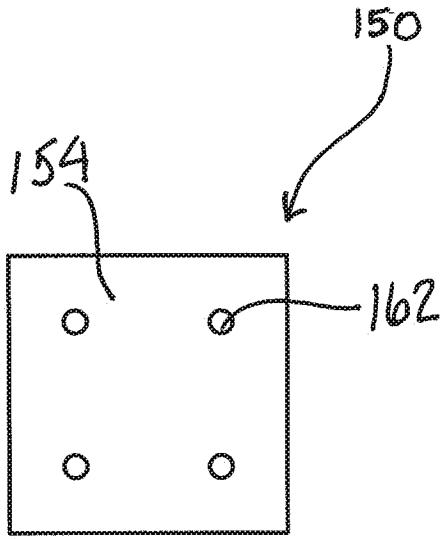
FIG. 18 is a top view of the connector of FIG. 16.
Figure 2D:
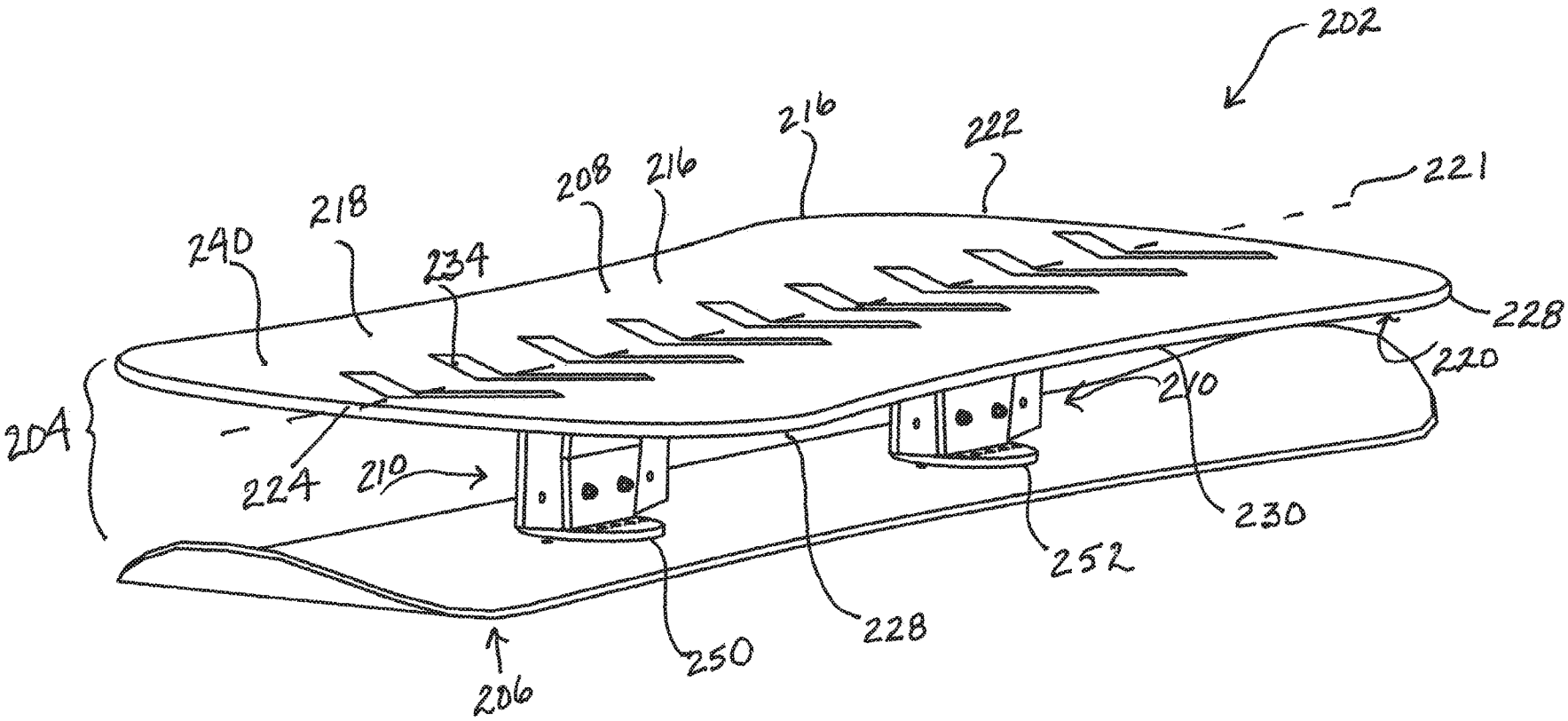

As shown in FIGS. 12-15, control deck 108 further illustratively includes a stringer 136 coupled to lower surface 120 of platform 116. Stringer 136 is configured to receive connectors 150, 152 as discussed in greater detail herein. Stringer 136 longitudinally extends along longitudinal axis 121 of control deck 108 from a first end 138 to a second end 140 opposite first end 138. As shown in FIG. 12, stringer 136 extends the length of platform 116 to each end 122, 124. Stringer 136 is illustratively coupled to lower surface 120 of platform 116 using a plurality of mechanical fasteners 141. In addition to fasteners 141, stringer 136 may be further coupled to lower surface 120 using, for example, a structural adhesive. In an alternative embodiment, stringer 136 is coupled to lower surface 120 using only a structural adhesive. It is also contemplated that stringer 136 may be integrally formed with platform 116. As shown, long edges 143 of stringer 136 are generally perpendicular to lower surface 120, and short edges 145 include a chamfer 147 relative to lower surface 120. However, it is contemplated that in alternate embodiments, stringer 136 may comprise a contoured profile similar to that of stringer 136.

As best shown in FIGS. 16-19, illustrative connector assembly 110 is selectively adjustable to change a distance between runner 106 and control deck 108. More specifically, connector assembly 110 comprises a front or fore connector 150 and a rear of aft connector 152. Each of connectors 150, 152 are substantially the same, and comprises an upper portion 154 and a lower portion 158. Upper portion 154 is configured to couple to stringer 136, and upper portion 154 includes at least one aperture (not shown) configured to receive a mechanical fastener, such as, for example, a bolt, to couple upper portion 154 to stringer 136. In addition, lower portion 158 is configured to couple to snowboard 114. Lower portion 158 includes a plurality of apertures 168 configured to receive a mechanical fastener 169, such as, for example, a bolt, for coupling lower portion 158 to snowboard 114.

Still referring to FIGS. 16-19, spacer 156 is illustratively coupled intermediate upper portion 154 and lower portion 158. An operator may selectively position spacer 156 between upper portion 154 and lower portion 158 to selectively adjust, i.e., increase, a distance D between control deck 108 and runner 106. The operator may also selectively adjust, i.e., decrease, distance D by removing spacer 156 such that upper portion 154 and lower portion 158 of each of connectors 150, 152 are directly coupled to one another. The operator may further selectively adjust, i.e., decrease, distance D by removing both spacer 156 and one of upper portion 154 and lower portion 158 of each of connectors 150, 152 such that the remaining upper portion 154 or lower portion 158 of each of connectors 150, 152 are directly coupled to control deck 108 and snowboard 114. As shown, spacer 156 has a height $H_S$, and the addition or removal of spacer 156 changes distance D by height $H_S$. It is contemplated, however, that spacers of height greater or smaller than height $H_S$ may be used.

Sled attachment 104 may be sold as a kit. The kit may include a plurality of spacers 156 each having a unique height. By including the plurality of spacers 156 in the kit, a user can selectively adjust the distance between control deck 108 and runner 106 and the height of connector assembly 110 to different heights as previously discussed. One advantage of selectively adjusting the height of connector assembly 110 is that the operator may customize distance D for, among other factors, performance or personal preference. While an exemplary embodiment of connector assembly 110 has been illustrated as being selectively adjustable by adding, removing, or changing the height of specific parts of connector assembly 110, it is contemplated that distance D or the overall height of connector assembly 110 may be adjusted in an alternative way. For example, connector assembly 110 may comprise an indexed height adjustment mechanism for changing distance D.

Turning now to FIGS. 20-35, an alternative sled 202 is shown, which comprises many similar components to sled 2. In particular, sled 202 comprises a sled attachment 204 coupled to a runner 206. Sled attachment 204 includes a control deck 208 coupled to a connector assembly 210. Control deck 208 is configured to support an operator 12 (FIG. 36) during operation of sled 202, and connector assembly 210 supports deck 208 above runner 206. Illustratively, runner 206 is configured to support operator 12 for movement along a low friction surface, such as, for example, snow, ice, sand, or wet grass. In the embodiment shown, runner 206 comprises a snowboard.

As shown in FIGS. 20-27, control deck 208 comprises a platform 216 having an upper surface 218 and a lower surface 220 opposite upper surface 218. Platform 216 extends longitudinally along a longitudinal axis 221 from a first end 222 to a second end 224. Platform 216 includes a contoured perimeter 226 with rounded edges 228 at each of ends 222, 224. In addition, platform 216 includes side cuts 230 to outline a waist of platform 216 similar to waist 32 of platform 16 as previously described. It is contemplated, however, that platform 216 may include a generally constant width along its length or, alternatively, a wider middle width than at either of ends 222, 224. Upper surface 218 is a non-slip surface and includes a visual indicator such as a plurality of arrows 234 to indicate to an operator a front end, illustratively first end 222, and a rear end, illustratively second end 224, of control deck 208 or an intended direction of travel or operation of sled 202.

As shown in FIGS. 24-27, control deck 108 further may include slots 248, 249 on lower surface 220 of platform 216 to allow connectors 254, 256 to be repositioned along lower surface 220 prior to securely coupling connectors 254, 256 to lower surface 220 of platform 216 as discussed herein. As shown, slots 248 include a fore slot 248 and an aft slot 249 spaced apart from fore slot 248 along longitudinal axis 221 with each of fore slot 248 and aft slot 249 extending along a portion of a length of lower surface 220. It is contemplated, however, that lower surface 220 may include a single slot extending along a length thereof. Each of slots 248, 249 illustratively includes a T-slot track configured to receive a T-slot connector, such as a T-slot nut or a T-slot bolt. In this way, the position of control deck 208 and platform 216 relative to runner 206 along longitudinal axis 221 is infinitely adjustable. The adjustability along longitudinal axis 221 is only limited by the length of slots 248, 249, which can be as long as control deck 208. Conversely, connectors 254, 256 could be coupled directly to platform 216 through a series of apertures in both connectors 254, 256 and platform 216 through which fasteners such as bolts or screws would be inserted. Alternatively, connectors 254, 256 could be coupled to platform 216 according to any of the other embodiments discussed herein or an equivalent.

As best shown in FIGS. 28-35 connector assembly 210 is selectively adjustable to change a distance between runner 206 and control deck 208. More specifically, connector assembly 210 comprises a front or fore connector 250 and a rear or aft connector 252. Each of connectors 250, 252 is substantially the same, and comprises an upper portion 254 and a lower portion 256. Upper portion 254 is configured to couple to lower surface 220 of platform 216, and upper portion 254 includes at least one aperture 271 configured to receive a mechanical fastener, such as, for example, a bolt, to couple upper portion 254 to lower surface 220 of platform 216. In addition, lower portion 256 is configured to couple to runner or snowboard 206. Lower portion 256 includes a plurality of apertures 272 configured to receive a mechanical fastener, such as, for example, a bolt, for coupling lower portion 256 to snowboard 206. A spacer 270 extends between, and couples together, upper portion 254 and lower portion 256 of connectors 250, 252.

Figure 21:
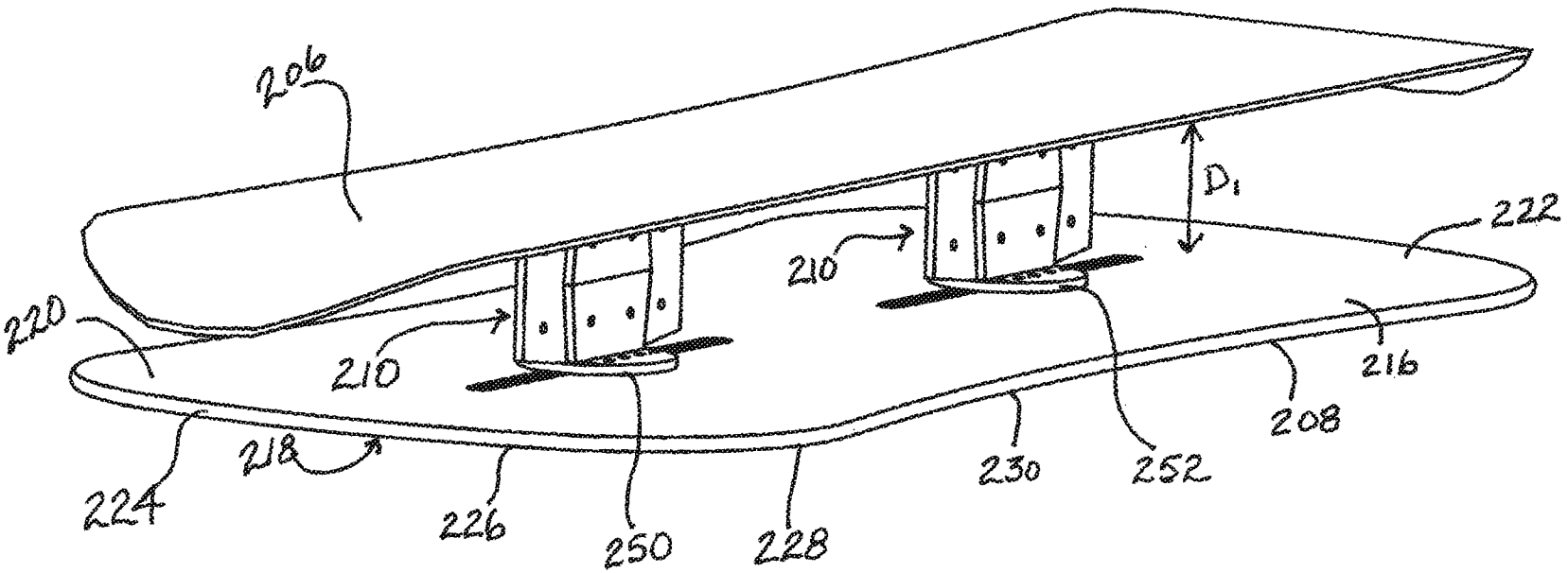
FIG. 21 is a front, bottom perspective view of the sled of FIG. 20 also in a lowered configuration.
Figure 22:
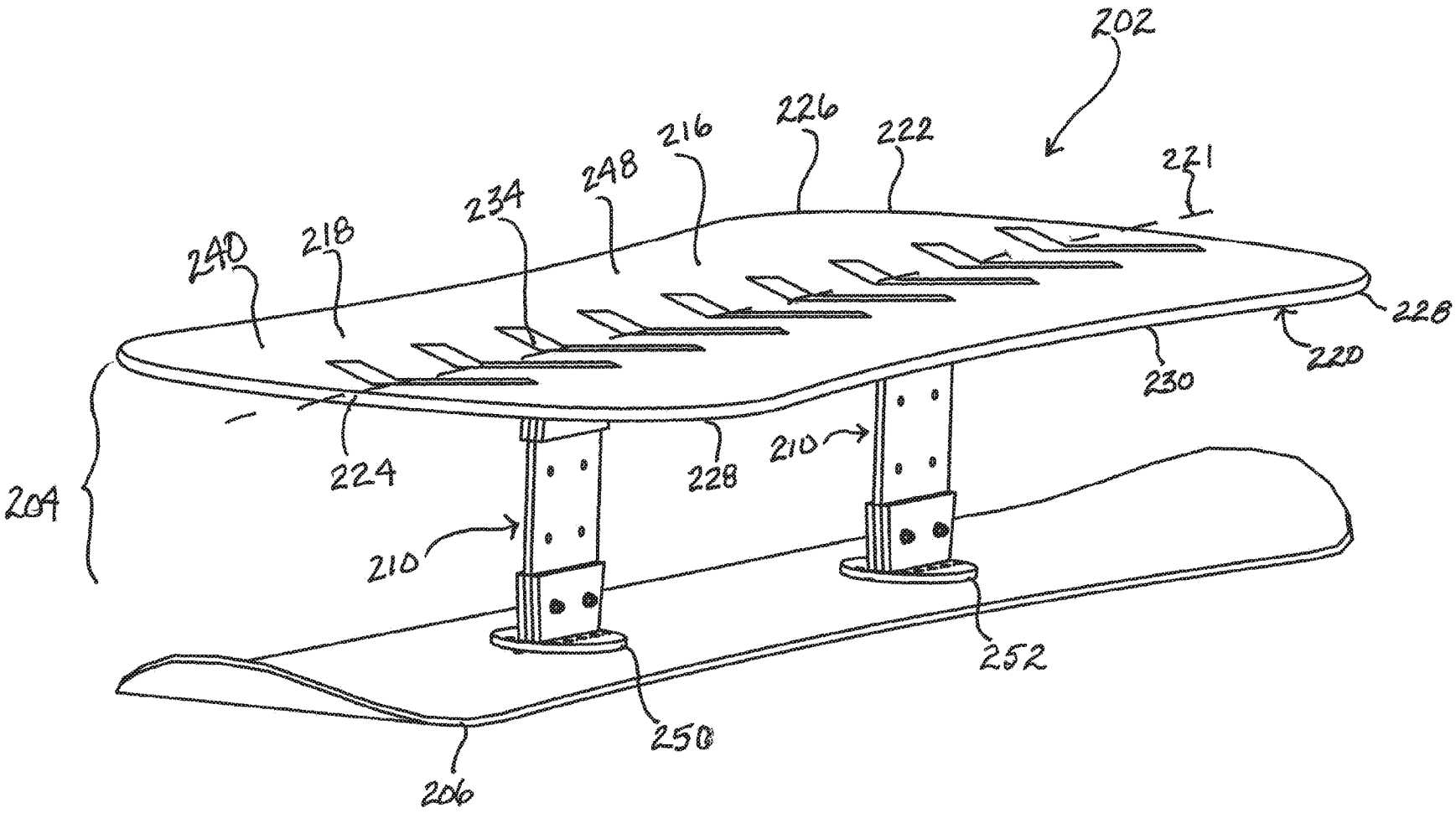
FIG. 22 is a front, top perspective view of the sled of FIG. 20 in a raised configuration.
Figure 23:
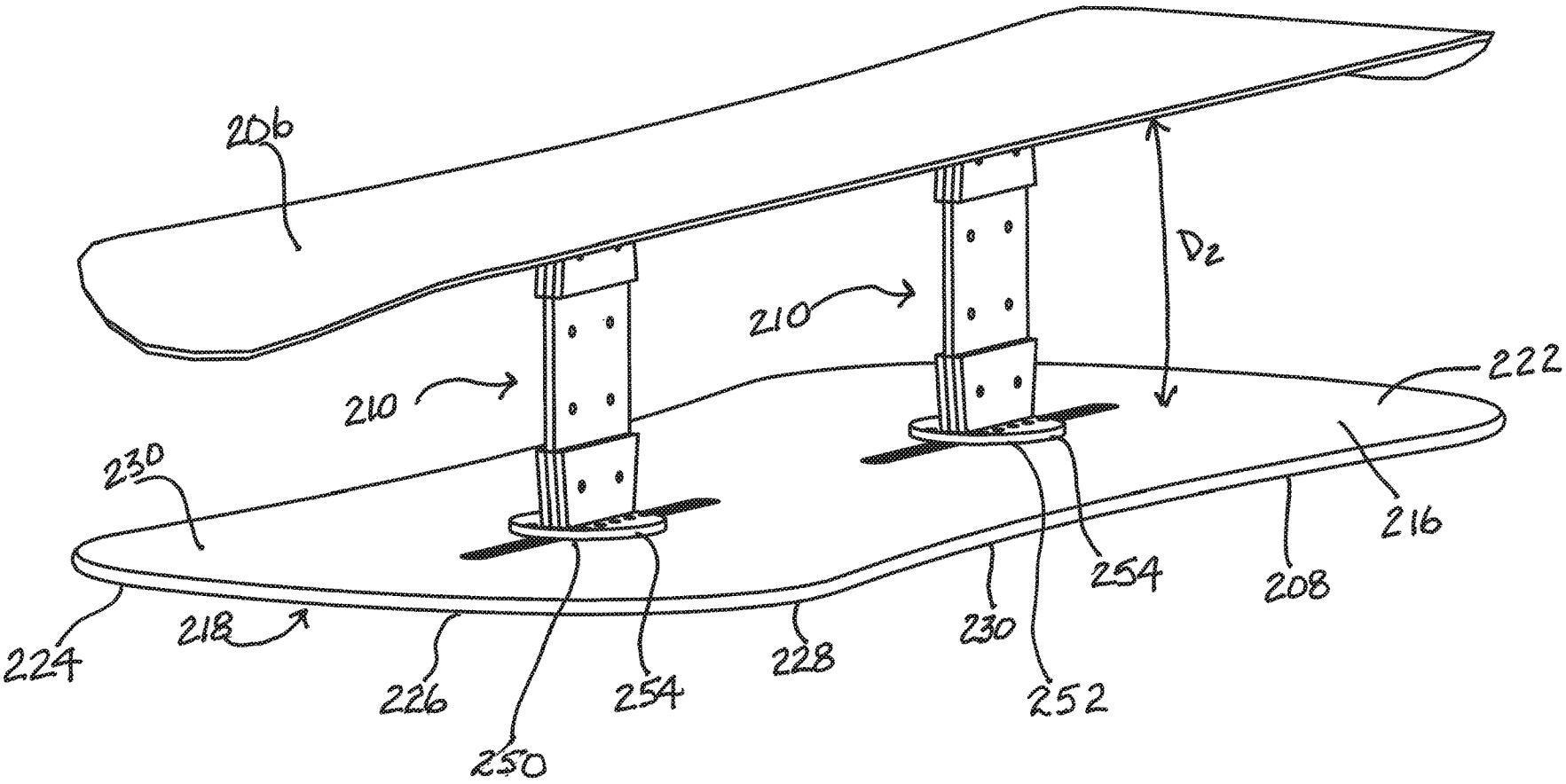
FIG. 23 is a front, bottom perspective view of the sled of FIG. 20 also in a raised configuration.
Figure 25:
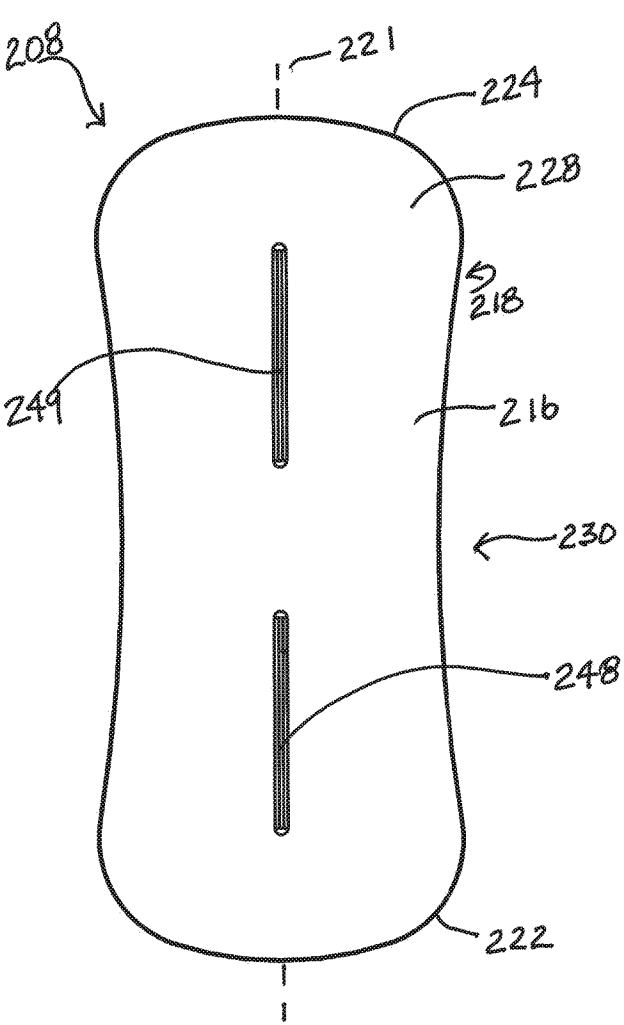
FIG. 25 is a bottom view of the control deck of FIG. 24.
Figure 24:
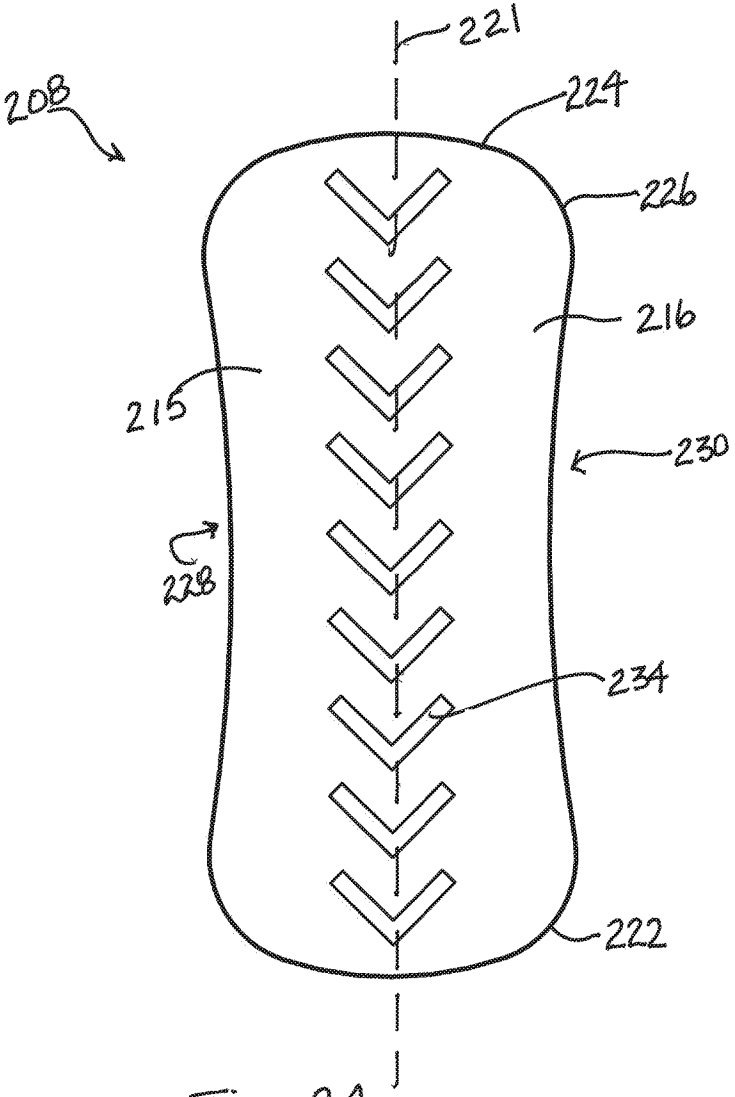
FIG. 24 is a top view of the control deck shown in the sled of FIG. 20.
Figure 27:
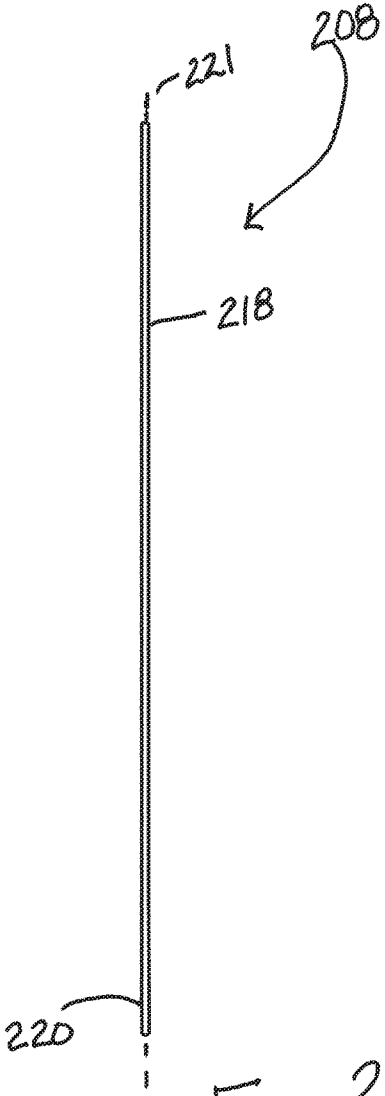
FIG. 27 is a side view of the control deck of FIG. 24.
Figure 26:
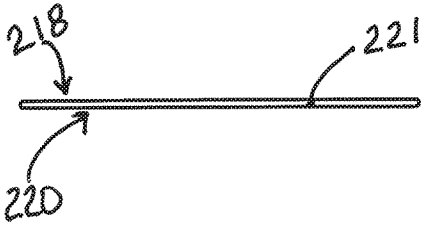
FIG. 26 is a front view of the control deck of FIG. 24.
Figure 29:
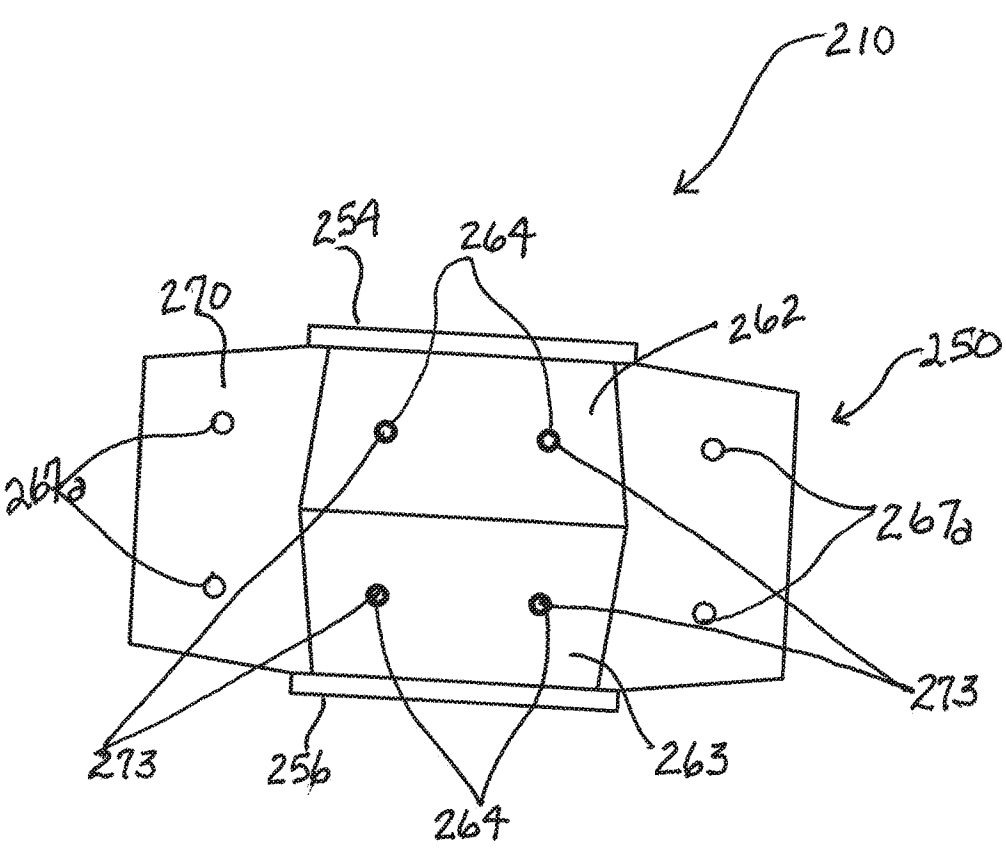
FIG. 29 is a side view of the connector of FIG. 28 also in a lowered configuration.
Figure 28:
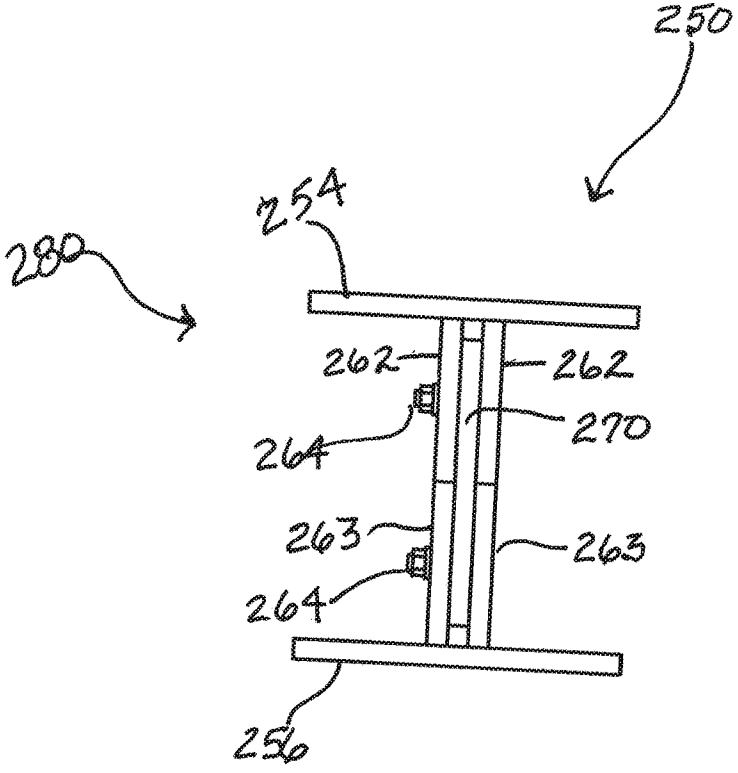
FIG. 28 is a front view of a connector or riser of the connector assembly shown in the sled of FIG. 20 in a lowered configuration.
Figure 31:
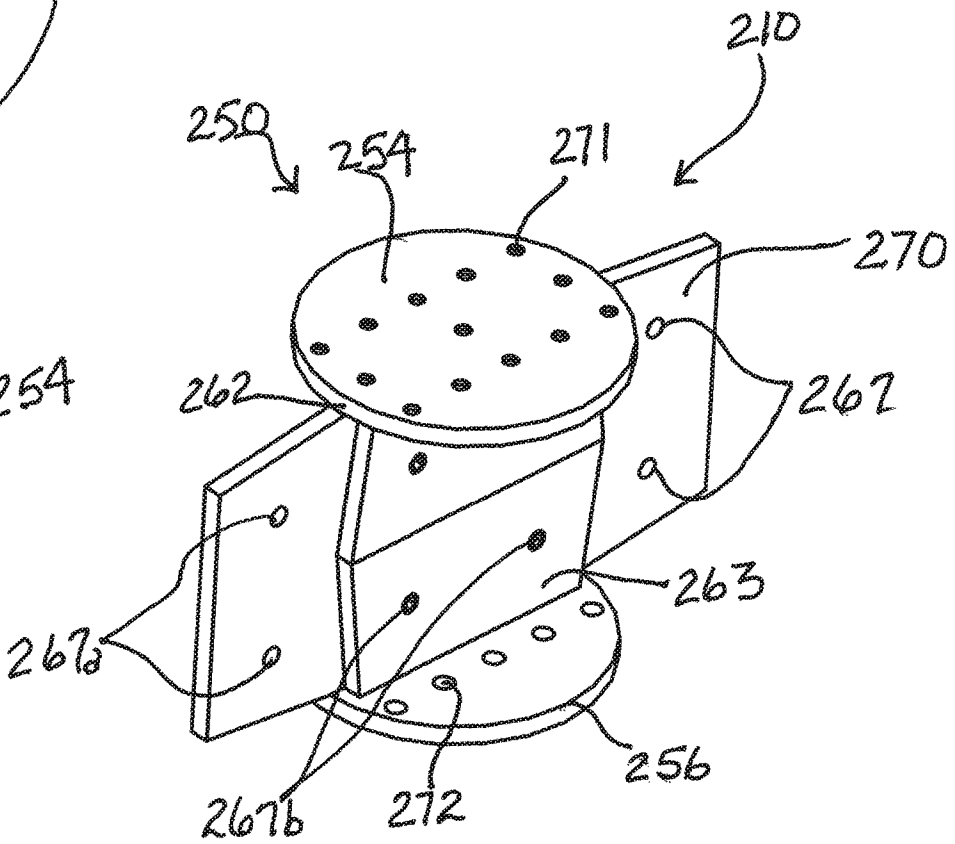
FIG. 31 is a front, perspective view of the connector of FIG. 28 also in a lowered configuration.
Figure 30:
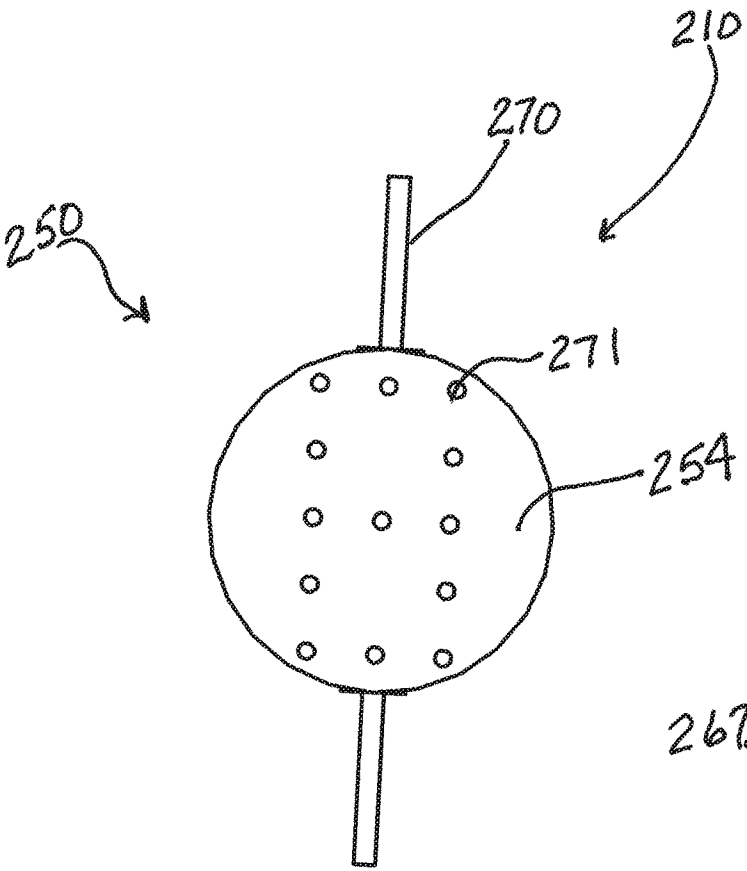
FIG. 30 is a top view of the connector of FIG. 28 also in a lowered configuration.
Figure 33:
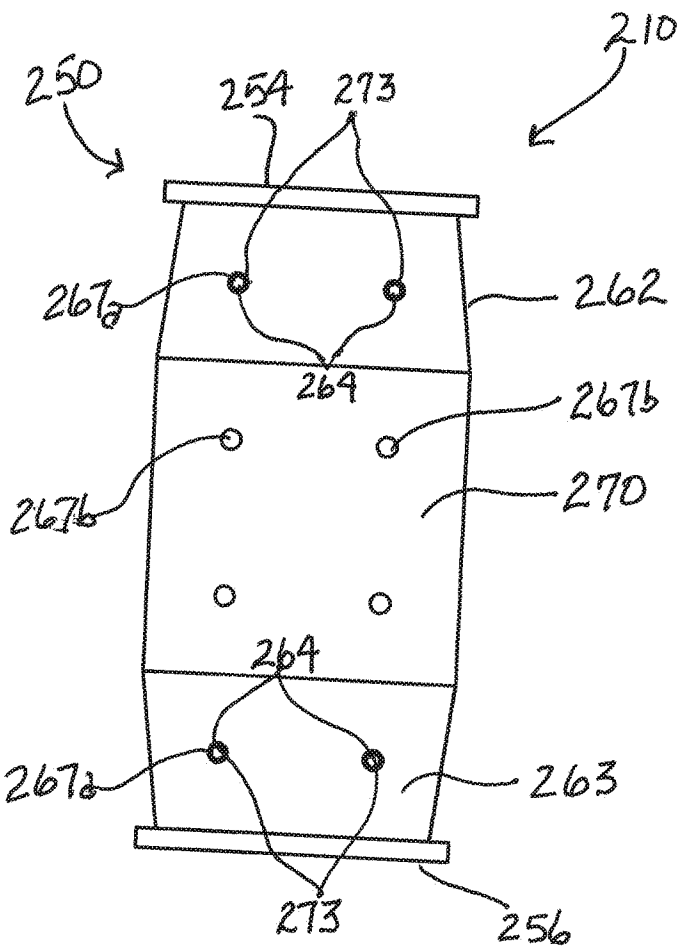
FIG. 33 is a side view of the connector of FIG. 32 also in a raised configuration.
Figure 32:
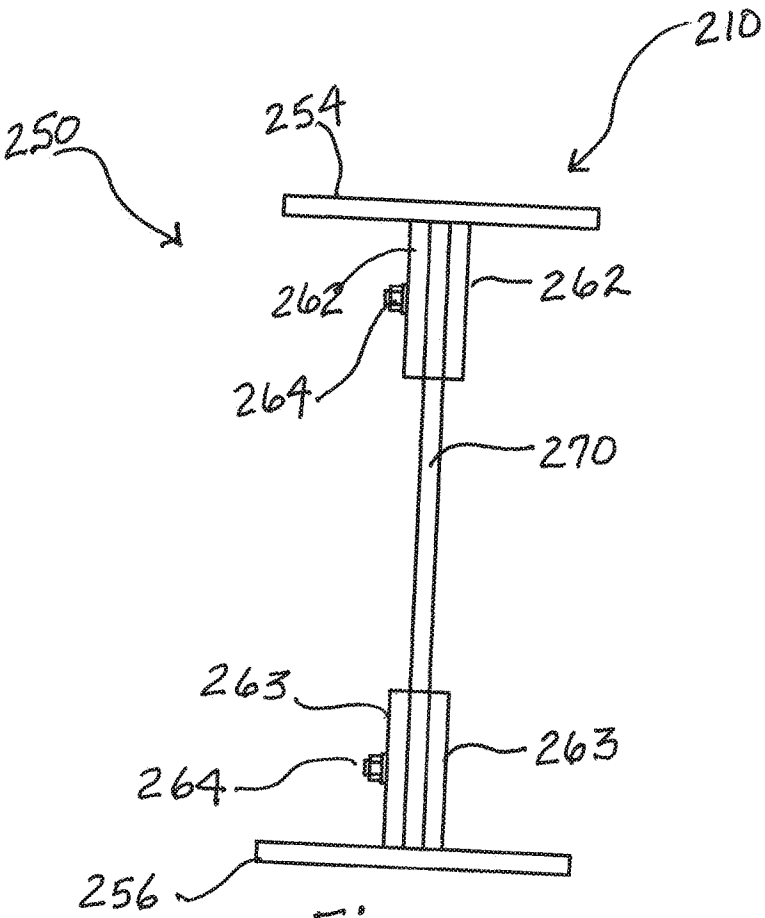
FIG. 32 is a front view of a connector or riser of the connector assembly shown in the sled of FIG. 20 in a raised configuration.
Figure 35:
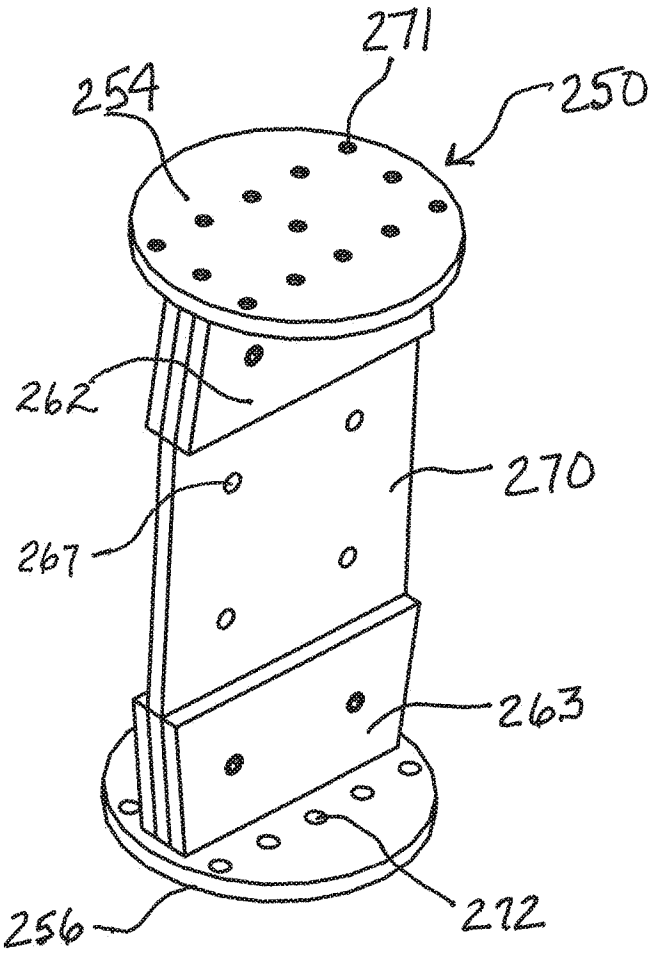
FIG. 35 is a front, perspective view of the connector of FIG. 32 also in a raised configuration.
Figure 34:
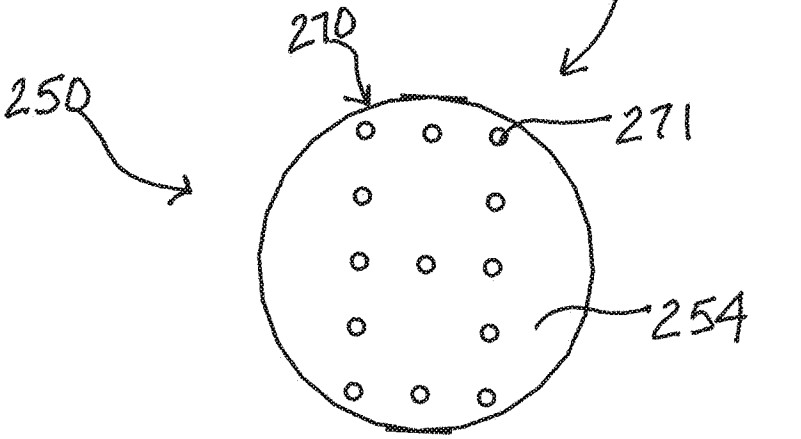
FIG. 34 is a top view of the connector of FIG. 32 also in a raised configuration.

Still referring to FIGS. 28-35, spacer 270 has two configurations (e.g., a vertical or raised configuration, and a horizontal or lowered configuration). Spacer 270 includes a series of apertures 267, wherein raised configuration (FIGS. 22-23, 32-25) is oriented 90 degrees about a horizontal axis from lowered configuration (FIGS. 20-21, 28-31). Some of the apertures 267*a* correspond to the raised configuration and some of the apertures 267*b* (FIG. 33) correspond to the lowered configuration depending upon the rotational orientation of the spacer 270. As shown in FIGS. 28-31, in the lowered configuration, spacer 270 is disposed horizontally between upper portion 254 and lower portion 256 to maintain height $D_1$ as shown in FIGS. 20-21. As shown in FIGS. 32-35, in the raised configuration, spacer 270 is rotated 90 degrees from the lowered configuration and disposed vertically between upper portion 254 and lower portion 256 to maintain height $D_2$ as shown in FIGS. 22-23.

Upper portions 254 of connectors 250, 252 include braces 262. Lower portions 256 of connectors 250, 252 include braces 263. Braces 262 and 263 extend vertically down from upper portion 254, and vertically up from lower portion 256, respectively, with a space in between that is sized and configured to receive spacer 270. Braces 262, 263 also include apertures 273 spaced to match apertures 267 of spacer 270. While spacer 270 is in the lowered configuration (FIG. 29), apertures 273 in braces 262, 263 align with the apertures 267*b* that correspond to the lowered configuration. While spacer 270 is in the raised configuration (FIG. 33), apertures 273 in braces 262, 263 align with the apertures 267*a* that correspond to the raised configuration. In this way, fasteners 264 can be inserted into the apertures of braces 262, 263 to securely mount spacer 270 in place, between braces 262 and braces 263. An operator may selectively position spacer 270 between upper portion 254 and lower portion 258 vertically or horizontally, to selectively adjust, i.e., increase, a distance D between control deck 208 and runner 206.

Sled attachment 204 may be sold as a kit. The kit may include a plurality of spacers 270 each having a unique height. By including the plurality of spacers 270 in the kit, a user can selectively adjust the distance between control deck 208 and runner 206 and the height of connector assembly 210 to different heights as previously discussed. One advantage of selectively adjusting the height of connector assembly 210 is that the operator may customize distance D for, among other factors, performance or personal preference. While an exemplary embodiment of connector assembly 210 has been illustrated as being selectively adjustable by adding, removing, or changing the height of specific parts of connector assembly 210, it is contemplated that distance D or the overall height of connector assembly 210 may be adjusted in an alternative way. For example, connector assembly 210 may comprise an indexed height adjustment mechanism for changing distance D.

Figure 36:
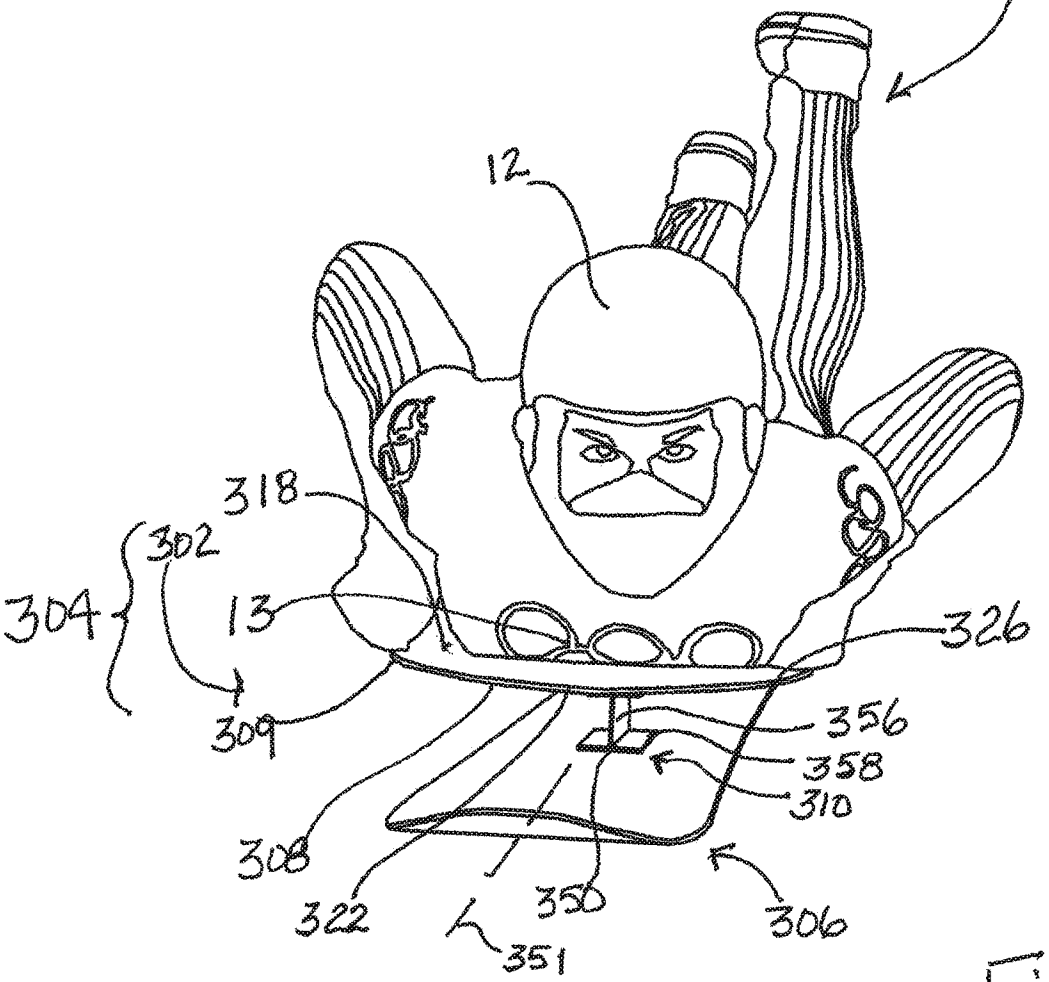
FIG. 36 is a perspective view of an operator using a further exemplary sled having a control deck, an alternative connector assembly, and a runner.

Turning now to FIG. 36, operator 12 is shown positioned on an illustrative sled 302. Sled 302 includes a sled attachment 304 coupled to a runner 306. Sled attachment 304 includes a control deck 308 and a connector assembly 310. Control deck 308 is configured to support operator 12 during operation of sled 302, and connector assembly 310 supports control deck 308 above runner 306. Runner 306 is configured to cooperate with deck 308 to support operator 12 for movement along a low friction surface, such as snow, ice, sand, or wet grass, for example. In the exemplary embodiment shown, runner 306 illustratively comprises a snowboard.

As shown in FIG. 36, connector assembly 310 includes a fore connector 350 and an aft connector (not shown). Similar to the connectors 50, 52, 150, 152, 250, 252 of connector assemblies 10, 110. 210 (FIGS. 1-9, 10-19, 20-35 respectively), fore connector 350 is coupled to and arranged along a longitudinal axis 321 of control deck 308 and runner 306. Fore connector 350 comprises a generally I-beam structure having an upper portion 354 coupled to control deck 308, a lower portion 358 coupled to runner 306, and a central column 356 extending from upper portion 354 to lower portion 358.

Operator 12 mounts deck 308 in the prone position to control sled 302. When operator 12 is mounted in the prone position, a chest 13 of operator 12 will be positioned proximate a first end 322 of deck 308 and feet 15 of operator 12 will be positioned proximate a second end of deck 308 opposite first end 322. In the exemplary embodiment shown, feet 15 of operator 12 extend rearward of the second end. When operator 12 is mounted in the prone position, operator 12 will be facing the intended direction of travel of sled 302. An operator may change the direction and/or speed of control deck 308 by shifting the operator's bodyweight laterally about longitudinal axis 321.

In addition, control deck 308 may include handholds 309 to allow an operator 12 to control and steer deck 308 when operator 12 is in the prone position on control deck 308. Stated another way, handholds 309 may provide a stabilizing point of contact such that operator 12 can move deck 308 about longitudinal axis 321 and thereby, control and steer sled 302 during operation. As shown, handholds 309 are positioned proximate first end 322 of deck 308. It is contemplated, however, that handholds 309 may be positioned at a different longitudinal location along deck 308. Moreover, handholds 309 may be integrally formed with a perimeter 326 of deck 308 or coupled to an upper surface 318 or a lower surface 320 of deck 308. While operator 12 is shown in the prone position, it is contemplated that operator 12 may recline atop deck 308 to control sled 302 on the low friction surface.

As mentioned above, sled attachments 4, 104, 204, 304 may be sold as a kit or accessory without runners 6, 106, 206, 306. An operator may couple sled attachments 4, 104, 204, 304 to a personalized or customized runner or snowboard, and where runners 6, 106, 206, 306 comprise a snowboard, the operator may extend the use of an existing snowboard or revitalize an unused snowboard.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A sled comprising:

a control deck;

a connector assembly coupled to and positioned below the control deck, the connector assembly including a fore connector and an aft connector, the aft connector spaced apart from the fore connector along the longitudinal axis of the control deck; and a runner coupled to the connector assembly and spaced apart from the control deck, the runner extending along a longitudinal axis of the control deck and being fixed relative to the control deck, wherein at least one of the fore connector and the aft connector comprises an upper portion independently coupled to the control deck, a lower portion independently coupled to the runner, and a body extending between the upper portion and the lower portion, a longitudinal length of the body being greater than a lateral width of the body.

2. The sled of claim 1, wherein the connector assembly is selectively adjustable to change a height of the connector assembly and thereby a distance between the runner and the control deck.

3. The sled of claim 1, wherein each of the fore connector and the aft connector includes a spacer positioned between the upper portion and the lower portion, the spacer rotatable to selectively adjust a height of the connector assembly.

4. The sled of claim 1, wherein the upper portion of each of the fore connector and the aft connector includes at least one aperture configured to receive a fastener for coupling the connector assembly to the control deck.

5. The sled of claim 4, wherein the runner includes a plurality of apertures and the lower portion of each of the fore connector and the aft connector includes a plurality of apertures corresponding to at least a portion of the plurality of apertures of the runner.

6. The sled of claim 5, wherein the runner comprises a snowboard.

7. The sled of claim 6, wherein the plurality of apertures of the runner comprise snowboard binding mounting holes.

8. A sled attachment comprising:

a control deck comprising a platform having an upper surface and a lower surface;

a connector assembly coupled to the control deck, the connector assembly extending downward from the control deck and positioned along a longitudinal axis of the control deck; and a stringer coupled to the lower surface of the platform, the stringer aligned along the longitudinal axis of the deck, the connector assembly coupled to the control deck through the stringer.

9. The sled attachment of claim 8, wherein the stringer includes at least one slot extending along a length of the slot, the connector assembly coupled to and selectively moveably along the slot.

10. The sled attachment of claim 8, wherein the connector assembly is repositionable along a length of the control deck.

11. The sled attachment of claim 8, wherein the connector assembly comprises a fore connector and an aft connector spaced apart from the fore connector, each of the fore connector and the aft connector comprising an upper portion and a lower portion, the lower portion of each of the fore connector and the aft connector including at least one aperture.

12. The sled attachment of claim 11, wherein the control deck has a first end and a second end opposite the first end, the fore connector positioned intermediate the first end of the control deck and the aft connector, the aft connector positioned intermediate the fore connector and the second end of the control deck.

13. The sled attachment of claim 8, wherein the control deck includes opposing side cuts to facilitate grasping by an operator.

14. A sled comprising:

a control deck;

a connector assembly coupled to and positioned below the control deck, the connector assembly including a fore connector and an aft connector, the aft connector spaced apart from the fore connector along the longitudinal axis of the control deck; and a runner coupled to the connector assembly and spaced apart from the control deck, the runner extending along a longitudinal axis of the control deck, wherein each of the fore connector and the aft connector comprises an upper portion independently coupled to the control deck, a lower portion independently coupled to the runner, and a removable spacer positioned between the upper portion and the lower portion to selectively adjust a height of the connector assembly, and the upper and lower portions are configured to be coupled together when the removable spacer is removed.

15. The sled of claim 14, wherein the removable spacer has a longitudinal length and a lateral width that are substantially similar.

16. The sled of claim 14, wherein a longitudinal length of each of the fore connector and the aft connector is substantially similar to a lateral width of each of the fore connector and the aft connector.

17. The sled of claim 14, wherein at least one of the upper portion and the lower portion includes a through opening extending along a longitudinal length of the at least one of the upper portion and the lower portion.

18. The sled of claim 1, wherein the at least one of the fore connector and the aft connector includes a through opening extending along the longitudinal length of the at least one of the fore connector and the aft connector.

* * * * *